United States Patent [19]

Otsuka et al.

[11] Patent Number: 5,011,552

[45] Date of Patent: Apr. 30, 1991

[54] METHOD FOR PRODUCING A RARE EARTH METAL-IRON-BORON PERMANENT MAGNET BY USE OF A RAPIDLY-QUENCHED ALLOY POWDER

[75] Inventors: Tsutomu Otsuka; Etsuo Otsuki, both of Miyagi, Japan

[73] Assignee: Tokin Corporation, Sendai, Japan

[21] Appl. No.: 438,724

[22] Filed: Nov. 17, 1989

Related U.S. Application Data

[63] Continuation of Ser. No. 97,656, Sep. 18, 1987, abandoned.

[30] Foreign Application Priority Data

| | | | |
|---|---|---|---|
| Sep. 16, 1986 | [JP] | Japan | 61-217629 |
| Jan. 30, 1987 | [JP] | Japan | 62-18709 |
| Apr. 9, 1987 | [JP] | Japan | 62-85676 |
| Apr. 11, 1987 | [JP] | Japan | 62-87917 |
| May 18, 1987 | [JP] | Japan | 62-120826 |

[51] Int. Cl.[5] ..... H01F 1/053

[52] U.S. Cl. ..... 148/302; 420/83; 420/121

[58] Field of Search ..... 148/302; 420/83, 121

[56] References Cited

FOREIGN PATENT DOCUMENTS 0101552 2/1984 European Pat. Off. .
0106948 5/1984 European Pat. Off. .
0177371 4/1986 European Pat. Off. .
0184722 6/1986 European Pat. Off. .
0197712 10/1986 European Pat. Off. ..... 148/302

*Primary Examiner*—John P. Sheehan
*Attorney, Agent, or Firm*—Hopgood, Calimafde, Kalil, Blaustein & Judlowe

[57] ABSTRACT

A rare earth metal-iron-boron permanent magnet is produced by a sintering method using a magnetic powder prepared from an ingot of $R_2Fe_{14}B$ and another powder prepared from a rapidly-quenched alloy ribbon of R-T-B. R is least one element selected from the group consisting of yttrium and rare earth metals and T is at least one element selected from the group consisting of transition metals. During sintering almost all the rapidly-quenched alloy powder melts to form a liquidus phase which cements the magnetic particles at a sintering temperature. The liquidus phase generates a magnetic crystalline phase and a solid solution phase upon cooling from the sintering temperature. A comparatively large amount of rapidly-quenched alloy powder is used to produce a magnet having a reduced amount of solid solution phase. In addition to this, the rapidly-quenched alloy can readily be finely ground and the rapidly-quenched alloy powder can therefore be uniformly mixed with the magnetic alloy powder so that a magnet having excellent magnetic properties can be produced wherein the magnetic particles are uniformly dispersed in the small amount of the solid solution phase. The magnet also has a reduced oxygen content.

12 Claims, 15 Drawing Sheets

METHOD FOR PRODUCING A RARE EARTH METAL-IRON-BORON PERMANENT MAGNET BY USE OF A RAPIDLY-QUENCHED ALLOY POWDER

This application is a continuation of Ser. No. 097,656 filed Sept. 16, 1987, now abandoned.

BACKGROUND OF THE INVENTION (1) Field of the Invention

This invention relates to a permanent magnet material of a bulk shape and, in particular, to a rare earth metal-iron-boron (R-Fe-B) permanent magnet material with a high energy product.

(2) Description of the Prior Art

Permanent magnets have been used in various applications such as electromechanical apparatus.

Recently, demands for Sm-Co permanent magnets have increased in place of known alnico magnets, ferrite magnets, and other conventional magnets, because of the high energy product of Sm-Co magnets. However, the Sm-Co magnets are expensive because of use of cobalt.

Therefore, various approaches are made for new permanent magnets which are economical and have an increased energy product.

A possible approach has been directed to a novel intermetallic compound of transition metal (T) and rare earth metal (R) instead of the Sm-Co intermetallic compound.

However, the intermetallic compounds without use of Co have been considered impossible to produce a magnet having coercivity which is associated with magnetocrystalline anisotropy because the compounds have an easy magnetization direction in the crystal phase. A reference is made to K. J. Strnat; IEEE Trans. Mag. (1972) 511.

In Appl. Phys. Lett. 39(10) (1981), 840, N. C. Koon and B. N. Das disclosed magnetic properties of amorphous and crystallized alloy of $(Fe_{0.82}B_{0.18})_{0.9}Tb_{0.05}La_{0.05}$. They wrote that crystallization of the alloy occurred near the relatively high temperature of 900 K, which also marked the onset of dramatic increase in the intrinsic coercive force. They found out that the alloy in the crystallized state appeared potentially useful as low cobalt permanent magnets.

It is considered that magnetically hard intermetallic compound of R-Fe-B (R=Tb and La) is formed in the alloy. Reviewing the R-Fe-B (R=Gd, Sn, Nd), ternary phase diagram by N. F. Chaban, Y. B. Kuz'ma, N. S. Bilonizhko, O. O. Kachmar and N. W. petriv; Dopodivi Akad. Nuk. Ukr. RSR, Ser. A (1979) No.10, P.P. 875–877, the intermetallic compound R-Fe-B (R=Tb and La) by Koon et al is guessed to be represented by $R_3Fe_{16}B$, which is confirmed to be $Nd_2Fe_{14}$by J. J. Croat et al. Reference is made to J. J. Croat, J. F. Herbst, R. W. Lee and F. E. Pinkerton; J. Appl. Phys, 55 (1984) 2078.

Therefore, considering the saturation magnetization of an intermetallic compound of R-T as shown in the above-described reference by K. J. Strnat, it can be guessed that use of Ce, Pr, and/or Nd for R in Fe-B-R alloy can provide better magnetic properties for permanent magnets than the Fe-B-La-Tb alloy.

J. J. Croat proposed amorphous (Nd and/or Pr)-Fe-B alloy having magnetic properties for a permanent magnet as disclosed in JP-A-60009852. Those magnetic properties were considered to be caused by a microstructure where $Nd_2Fe_{14}B$ particles having a particle size of 20–30 nm were dispersed within an amorphous Fe phase. Reference is further made to R. K. Mishra: J. Magnetism and Magnetic Materials 54–57 (1986) 450.

However, the amorphous alloy can provide only an isotropic magnet because of its crystallographically isotropy. This means that a high performance permanent magnet cannot be obtained from the amorphous alloy.

Sagawa, Fujiwara, and Matsuura proposed an anisotropic R-Fe-B sintered magnet in JP-A-59046008 which was produced from an ingot of an alloy of R (especially Nd), Fe, and B by conventional powder metallurgical processes. The sintered magnet has more excellent magnetic properties for permanent magnets than the known Sm-Co magnets.

The R-Fe-B sintered magnet comprises a metallic solid solution phase and magnetic crystalline particles dispersed within the metallic solid solution. Each the magnetic crystalline particles comprises an intermetallic chemical compound represented by $R_2Fe_{14}B$. The metallic solid solution phase comprises the R rich alloy out of stoichiometric compound of $R_2Fe_{14}B$. Since R especially Nd is active to oxygen and the R rich solid solution phase is very active to oxygen. Therefore, any care is necessary so as to prevent the magnet from oxidation.

In production of the R-Fe-B sintered magnet, an R rich ingot of the R-Fe-B alloy is prepared and is pulverized and ground into a powder having an average particle size of about 3–5 μm. The powder is compacted into a desired shape and is sintered. However, the ingot comprises the magnetic crystalline phase of the chemical compound $R_2Fe_{14}B$ and the solid solution phase. Therefore, the alloy tends to be oxidized in production of the magnet, especially at the grinding step. Actually, the sintered R-Fe-B magnet usually contains oxygen of about 3,000 ppm.

Furthermore, the solid solution phase can hardly be finely ground and the ground powder unavoidably contains coarse particles of the solid solution phase in comparison with the $R_2Fe_{14}B$ particles after the grinding step. Therefore, it is impossible to uniformly mix the solid solution powder with the $R_2Fe_{14}B$ powder. This means that magnetic particles are not uniformly dispersed in the solid solution phase in the sintered magnet, which impedes enhancement of the magnetic properties.

It is desired for obtaining a high energy product that the amount of the solid solution phase be reduced. However, decrease of amount of the solid solution phase results in incomplete sintering.

DESCRIPTION OF THE INVENTION

Therefore, it is an object of the present invention to provide an R-Fe-B sintered permanent magnet body with an improved magnetic properties and with a reduced oxygen inclusion.

It is another object of the present invention to provide an R-Fe-B sintered permanent magnet body with an improved corrosion resistance.

It is a specific object of the present invention to provide a method for producing an R-Fe-B sintered permanent magnet body having properties as described above.

Briefly speaking, the present invention attempts to use rapidly-quenched alloy powder for providing the metallic solid solution phase in the magnet. While, magnetic $R_2Fe_{14}B$ alloy powder is prepared from an ingot of the alloy.

The rapidly-quenced alloy is prepared by the continuous splat-quenching method which is disclosed in, for example, a paper entitled with "Low-Field Magnetic Properties of Amorphous Alloys" written by Egami, Journal of The American Ceramic Society, Vol. 60, No. 3-4, Mar.-Apr. 1977, p.p. 128-133. The rapidly-quenched alloy has a microstructure that is almost completely amorphous and/or very fine crystalline of a small size such as 1 μm or less.

Since the rapidly-quenched alloy contains a reduced amount of oxygen and is hardly oxidized, the resultant magnet also contains a reduced amount of oxygen.

Since the rapidly-quenched alloy comprises a composition equivalent to the liquidus phase, the rapidly-quenched alloy powder almost all melts to form liquidus phase at the sintering temperature. The magnetic particles are cemented to one another by the liquidus phase so that the sintering can be completed. Furthermore, the liquidus phase partially forms the solid solution phase with the remaining part of the liquidus phase forming a magnetic crystal phase when the sintered body is cooled from the sintering temperature. Thus, it is possible to use a comparatively large amount of the rapidly-quenched alloy powder with a result of a reduced amount of the solid solution phase in the magnet. Furthermore, the rapidly-quenched alloy powder can readily be finely ground. Accordingly, the rapidly-quenched alloy powder can be uniformly mixed with the magnetic $R_2Fe_{14}B$ alloy powder. Therefore, it is possible to obtain a sintered magnet having improved magnetic properties due to a fact that the magnetic particles are uniformly dispersed within a small amount of the solid solution phase.

The present invention provides a method for producing an iron-rare earth metal-boron permanent magnetic body with a high energy product and a reduced oxygen content, the permanent magnet body comprising a solid solution phase and magnetic crystalline particles dispersed within the solid solution phase.

The method of the present invention comprises steps of preparing an ingot of R-T-B magnetic alloy comprising a magnetic intermetallic compound represented by a chemical formula of $R_2T_{14}B$, where R is at least one element selected from yttrium (Y) and rare earth metals, T being transition metal but comprising Fe 50-100 at % in the transition metal; pulverizing and milling the ingot to thereby prepare a magnetic alloy powder; preparing a rapidly quenched alloy body by rapidly quenching a melt comprising at least one metal element (R) selected from yttrium (Y) and rare earth metals and at least one of boron (B) and a transition metal (T); pulverizing and milling the rapidly quenched alloy body to thereby produce a rapidly-quenched alloy powder; mixing the rapidly-quenched alloy powder 70% or less by volume and the magnetic alloy powder of substantially balance to prepare a mixed powder; compacting the mixed powder into a compact body of a desired shape; and liquid sintering the compact body at an elevated liquid sintering temperature to produce the permanent magnetic body wherein said rapidly-quenched alloy powder melts to a liquidus phase which cements the magnetic alloy powder and a part of the liquidus phase substantially generates the magnetic crystalline particles and the remaining portion of the liquidus phase generates the solid solution phase upon cooling from the liquidus sintering temperature.

Another transition metal or metals can be added in addition of Fe in the magnetic alloy powder so as to improve the magnetic properties.

Also, various rare earth metals and various transition metals can be used or included in the rapidly-quenched alloy powder, so that various metallic elements can be present in the solid solution to readily improve properties such as coercive force, corrosion resistance and others.

The rapidly-quenched alloy contains iron (Fe) alone as said transition metal (T). The transition metal may be at least one element selected from a group of Co, Ni, Cr, V, Ti, Mn, Cu, Zn, Zr, Nb, Mo, Hf, Ta, Al, Sn, Pb, and W. An amount of at least one selected from Ni, Cr, V, Ti, and Mn is up to 0.7 molal ratio. An amount of at least one selected from Cu and Zn is up to 0.6 molal ratio. An amount of at least one selected from Zr, Nb, Mo, Hf, Ta, and W is up to 0.4 molal ratio.

Further objects and features will be understood from the following description of examples with reference to the accompanying drawings.

Figure 1:
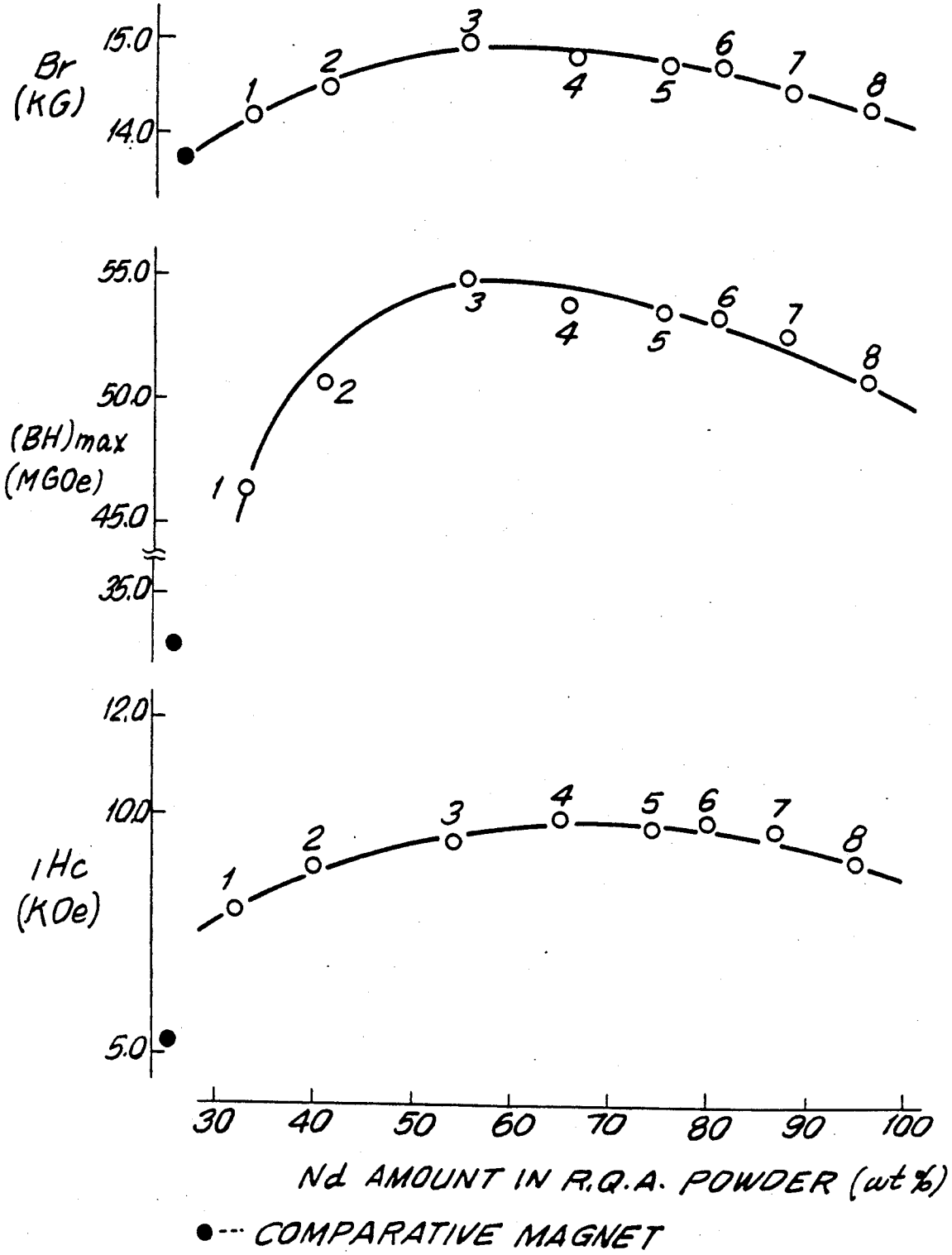
FIG. 1 is a graph showing magnetic properties of sample magnets in Example 1.

Examples will be described below.

At first, description is made as to preparation of magnetic alloy (M.A.) powders and rapidly-quenched alloy (R.Q.A.) powders which are used in some of the following examples.

Twelve ingots of Nd-Fe-B M.A. Nos. 1-12 as shown in Table 1 were prepared from start materials of Nd having a purity factor of 95% or more, Fe, and B having purity factors of 99% by the induction melting in argon gas atmosphere. Those alloys comprises an intermetallic compound represented by $Nd_2Fe_{14}B$ as a main phase therein and are magnetic alloys. Each of those eight alloy ingots were pulverized by a crusher to have a particle size below 24 mesh (Tyler).

TABLE 1

| M.A. No. | 1 | 2 | 3 | 4 | 5 | 6 |
|---|---|---|---|---|---|---|
| Nd (wt. %) | 23.0 | 25.0 | 27.0 | 28.0 | 29.0 | 30.0 |
| B (wt. %) | 1.0 | 1.0 | 1.0 | 1.0 | 1.0 | 1.0 |
| Fe (wt. %) | bal. | bal. | bal. | bal. | bal. | bal. |
| M.A. No. | 7 | 8 | 9 | 10 | 11 | 12 |
| Nd (wt. %) | 31.0 | 23.0 | 25.0 | 27.0 | 29.0 | 31.0 |
| B (wt. %) | 1.0 | 1.2 | 1.2 | 1.2 | 1.2 | 1.2 |
| Fe (wt. %) | bal. | bal. | bal. | bal. | bal. | bal. |

While, from similar start materials of Nd, Fe, and B, fourteen ribbons of rapidly quenched alloys (R.Q.A.) Nos. 1-14 shown in Table 2 were prepared by the continuous splat-quenching method as described hereinbefore. Those fourteen (R.Q.A.) ribbons were pulverized by a crusher to have a particle size below 24 mesh (Tyler).

TABLE 2

| R.Q.A. No. | 1 | 2 | 3 | 4 | 5 |
|---|---|---|---|---|---|
| Nd (wt. %) | 32.0 | 40.0 | 54.0 | 65.0 | 74.0 |
| B (wt. %) | 1.0 | 1.0 | 0.8 | 0.6 | 0.6 |
| Fe (wt. %) | bal. | bal. | bal. | bal. | bal. |
| R.Q.A. No. | 6 | 7 | 8 | 9 | 10 |
| Nd (wt. %) | 80.0 | 87.0 | 95.0 | 54.0 | 65.0 |
| B (wt. %) | 0.3 | 0.2 | 0.1 | 1.0 | 1.0 |
| Fe (wt. %) | bal. | bal. | bal. | bal. | bal. |
| R.Q.A. No. | 11 | 12 | 13 | 14 | |
| Nd (wt. %) | 74.0 | 80.0 | 92.0 | 97.0 | |
| B (wt. %) | 1.0 | 1.0 | 1.0 | 1.0 | |
| Fe (wt. %) | bal. | bal. | bal. | bal. | |

EXAMPLE 1

Each R.Q.A. powder of Nos. 1-8 in Table 2 of 8 vol % was mixed with one or more powders of 92 vol % selected from those M.A. powders in Table 1, as shown in Table 3, so that the resultant mixture consists, by weight, of Nd 31%, B 1.0%, and the balance Fe. The powdery mixture was finely ground to have an average particle size of 3-5 μm by use of a ball mill and was compacted to a compact body in a magnetic field of 20 kOe under a pressure of 1.0 ton.f/cm$^2$. The compact body was loaded in a sintering furnace and sintered in argon atmosphere at a temperature of 1,000°-1,100° C. for two hours, and thereafter was cooled in the furnace.

TABLE 3

| Sample No. | MIXTURE (Nd 31.0, B 1.0, Fe bal. (wt. %)) M.A. (92 VOL. %) | | R.Q.A. (8 VOL %) |
|---|---|---|---|
| 1 | No. 5 = 4.6%, | No. 7 = 87.4% | No. 1 |
| 2 | No. 5 = 23.0%, | No. 7 = 69.0% | No. 2 |
| 3 | No. 5 = 87.4%, | No. 7 = 4.6% | No. 3 |
| 4 | No. 3 = 49.6%, No. 5 = 40.57%, | No. 10 = 1.0%, No. 11 = 0.83% | No. 4 |
| 5 | No. 3 = 85.65%, No. 5 = 4.9%, | No. 10 = 1.75%, No. 11 = 0.83% | No. 5 |
| 6 | No. 2 = 22.31%, No. 3 = 67.62%, | No. 9 = 0.69%, No. 10 = 1.38% | No. 6 |
| 7 | No. 2 = 57.41%, No. 3 = 30.91%, | No. 9 = 2.39%, No. 10 = 1.29% | No. 7 |
| 8 | No. 2 = 88.32%, | No. 9 = 3.68% | No. 8 |

The sintered body was subjected to an aging treatment by heating at a temperature of 500°-600° C. for one hour and then rapidly quenched. The resultant magnetic body was measured as to residual magnetic flux density Br, coercive force $_IH_c$, and maximum energy product (BH)max. The measured data are demonstrated with sample numbers 1-8 (Table 3) of magnets in FIG. 1.

As a comparative sample, starting materials of Nd, Fe, and B were blended with each other to obtain an alloy consisting, by weight, of Nd 31%, B 1.0%, and the balance Fe, and an ingot of the alloy was produced by use of an induction furnace, according to a prior art. The ingot was finely ground into a fine powder, which was, in turn, compacted into a compact body, sintered, and aged under similar condition as described above. Magnetic properties (Br, $_IH_c$, and (BH)max) of the resultant magnetic body are also shown at black pints in FIG. 1.

It is clearly understood from FIG. 1 that use of the R.Q.A. powder for the solid solution phase according to the present invention considerably improves the magnetic properties of the sintered rare earth-iron-boron magnet. With respect to residual magnetic flux density (Br), the comparative sample has 13.8 kGauss but samples according to the present invention has a value more than 14 kGauss and at maximum 15 kGauss. The comparative sample has a coercive force ($_IH_C$) not more than 5.3 kOe but the samples according to the present invention has higher coercive forces about 8-10 kOe. Further, the maximum energy product is 33 MGOe in the comparative sample but more than 46 MGOe, and 50 MGOe, at maximum 55 MGOe in samples according to the present invention.

FIG. 1 teaches us that the R.Q.A. powder having Nd 50-80 wt % achieves excellent magnetic properties such as Br, $_IH_C$, and (BH)max.

In order to clarify relationship between magnetic properties and amount of oxygen contained in the magnet, oxygen amount in each magnet of sample Nos. 1-3 and comparative sample in Table 1 was measured. The measured data are described in Table 4 together with magnetic properties.

TABLE 4

| Sample | Br | (BH)max | $_IH_C$ | Oxygen (ppm) |
|---|---|---|---|---|
| No. 1 | 14.2 | 46.5 | 7.8 | 1,850 |
| No. 2 | 14.5 | 50.0 | 8.5 | 1,460 |
| No. 3 | 15.1 | 55.0 | 9.1 | 980 |
| Comparative | 13.8 | 33.0 | 5.6 | 4,180 |

Table 4 teaches us that magnets according to the present invention contain a reduced amount of oxygen and have magnetic properties in comparison with the comparative sample magnet produced by the conventional sintering method.

EXAMPLE 2

R.Q.A. powder No. 1 in Table 2 was mixed with one or more selected from those M.A. powders in Table 1 to obtain nine mixtures having different mixing ratio of the R.Q.A. powder as shown in Table 5 but consisting, by weight, of Nd 31%, B 1.0%, and the balance Fe. Amounts of the R.Q.A. powder in nine mixtures were 5%, 10%, 20%, 30%, 40%, 50%, 60%, 70%, and 75% by volume, respectively.

TABLE 5

| Sample No. | MIXTURE (Nd 31.0, B 1.0, Fe bal. (wt. %)) M.A. (Vol. %) | | R.Q.A. No. 1 (Vol. %) |
|---|---|---|---|
| 9 | No. 5 = 2.37, | No. 7 = 92.63 | 5 |
| 10 | No. 5 = 4.95, | No. 7 = 85.05 | 10 |
| 11 | No. 5 = 10, | No. 7 = 70 | 20 |
| 12 | No. 5 = 15.05, | No. 7 = 54.95 | 30 |
| 13 | No. 5 = 20.1, | No. 7 = 39.9 | 40 |
| 14 | No. 5 = 25, | No. 7 = 25 | 50 |
| 15 | No. 5 = 30, | No. 7 = 10 | 60 |
| 16 | No. 3 = 25.05, | No. 5 = 4.96 | 70 |
| 17 | No. 3 = 12.5, | No. 5 = 12.5 | 75 |

Each of the nine mixtures were finely ground, compacted, sintered, and aged in the similar manner as in Example 1. Magnetic properties (Br, $_IH_C$, (BH)max) of the resultant nine magnets Nos. 1-9 were measured and the measured data are shown in a graph of FIG. 2 with sample numbers 9-16 where the axis of abscissa represents the volumetric ratio of the amorphous alloy powder in the mixture. In the figure, the magnetic properties of the comparative sample in Example 1 is also shown at black points.

Figure 2:
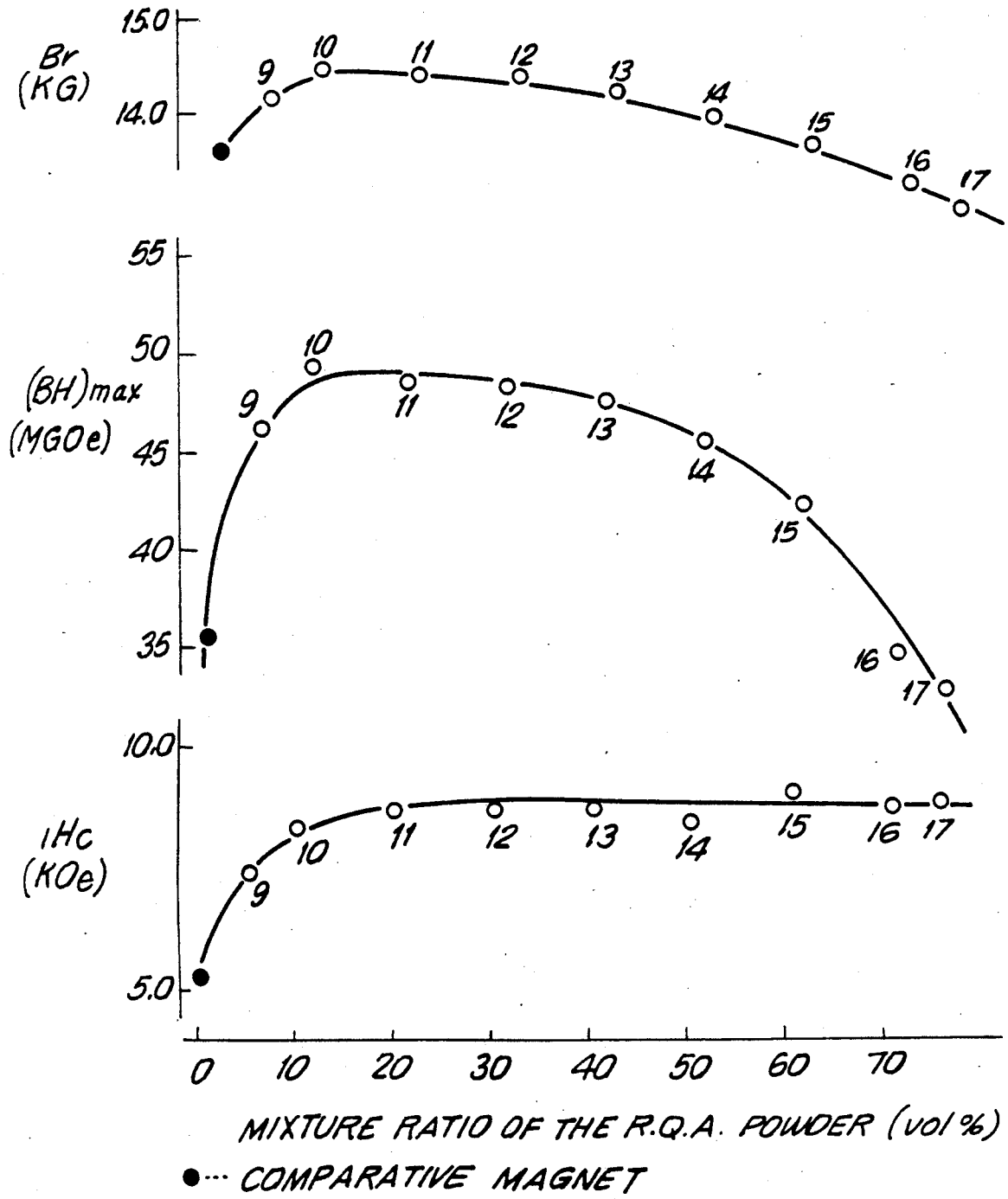
FIG. 2 is a graph showing magnetic properties of sample magnets in Example 2.

It will also be confirmed from FIG. 2 that use of the R.Q.A. powder considerably improves the magnetic properties of Nd-Fe-B permanent magnet. Use of the R.Q.A. powder of 5-60 vol % achieves a high energy product of 40 MGOe or more, and a higher energy product of 45 MGOe or more can be obtained by use of 5-50 vol % R.Q.A. powder.

As magnetic alloy powders, alloy powders containing Co were prepared as shown in Table 6 in the similar manner as described hereinbefore.

Those alloys are magnetic alloys and comprises, as a main phase therein, an intermetallic compound represented by $Nd_2(FeCo)_{14}B$ where 0.2 mol of Fe in $Nd_2Fe_{14}B$ is replaced by Co. Each of those four alloy ingots were pulverized by a crusher to have a particle size below 24 mesh (Tyler).

TABLE 6

| M.A. No. | 13 | 14 | 15 | 16 | 17 | 18 |
|---|---|---|---|---|---|---|
| Nd (wt. %) | 23.0 | 25.0 | 27.0 | 29.0 | 30.0 | 27.0 |
| Co (wt. %) | 15.8 | 15.4 | 15.0 | 14.8 | 14.4 | 7.6 |
| B (wt. %) | 1.0 | 1.0 | 1.0 | 1.0 | 1.0 | 1.0 |
| Fe (wt. %) | bal. | bal. | bal. | bal. | bal. | bal. |
| M.A. No. | 19 | 20 | 21 | 22 | 23 | |
| Nd (wt. %) | 27.0 | 27.0 | 27.0 | 27.0 | 27.0 | |
| Co (wt. %) | 22.5 | 29.8 | 37.0 | 44.0 | 51.2 | |
| B (wt. %) | 1.0 | 1.0 | 1.0 | 1.0 | 1.0 | |
| Fe (wt. %) | bal. | bal. | bal. | bal. | bal. | |

EXAMPLE 3

Each one of R.Q.A. powders Nos. 1, 2, 9-10 in Table 2 was mixed with one or more powders selected from M.A. powders Nos. 13-16 in Table 6 with a mixing ratio of 8 to 92 by volume as shown in Table 7 so that the resultant mixture consists, by weight, of Nd 30%, Co 14.4%, B 1.0%, and the balance Fe. The powdery mixture was finely ground to have an average particle size of 3-5 μm and compacted in the similar condition as in Example 1. The compact was sintered at a temperature of 1,000°-1,100° C. in argon gas for one hour and aged at a temperature of 500°-700° C. for one hour. The resultant magnetic body of sample numbers Nos. 18-25 in Table 7 was measured as to residual magnetic flux density Br, coercive force $_IH_c$, and maximum energy product (BH)max. The measured data are demonstrated together with sample numbers 18-25 in FIG. 3.

TABLE 7

| Sample No. | MIXTURE (Nd 30, Co 14.4, B 1.0, Fe bal. (wt %)) M.A. (92 Vol. %) | | R.Q.A. (8 Vol. %) |
|---|---|---|---|
| 18 | No. 17 = 76.4, | No. 16 = 15.6 | No. 1 |
| 19 | No. 17 = 8.3, | No. 16 = 83.7 | No. 2 |
| 20 | No. 16 = 39.6, | No. 15 = 52.4 | No. 9 |
| 21 | No. 15 = 80.5, | No. 14 = 11.5 | No. 10 |
| 22 | No. 15 = 39.6, | No. 14 = 52.4 | No. 11 |
| 23 | No. 15 = 11.0, | No. 14 = 81.0 | No. 12 |
| 24 | No. 14 = 50.1, | No. 13 = 41.9 | No. 13 |
| 25 | No. 14 = 28.5, | No. 13 = 63.5 | No. 14 |

As a comparative sample, starting materials of Nd, Fe, Co, and B were blended with each other to obtain an alloy consisting, by weight, of Nd 31%, Co 14.4% B 1.0%, and the balance Fe, and an ingot of the alloy was produced by use of an induction furnace, according to a prior art. The ingot was finely ground into a fine powder, which was, in turn, compacted into a compact body, sintered, and aged under similar condition as described above. Magnetic properties (Br, $_IH_c$, and (BH)max) of the resultant magnetic body are also shown at black points in FIG. 3.

Figure 3:
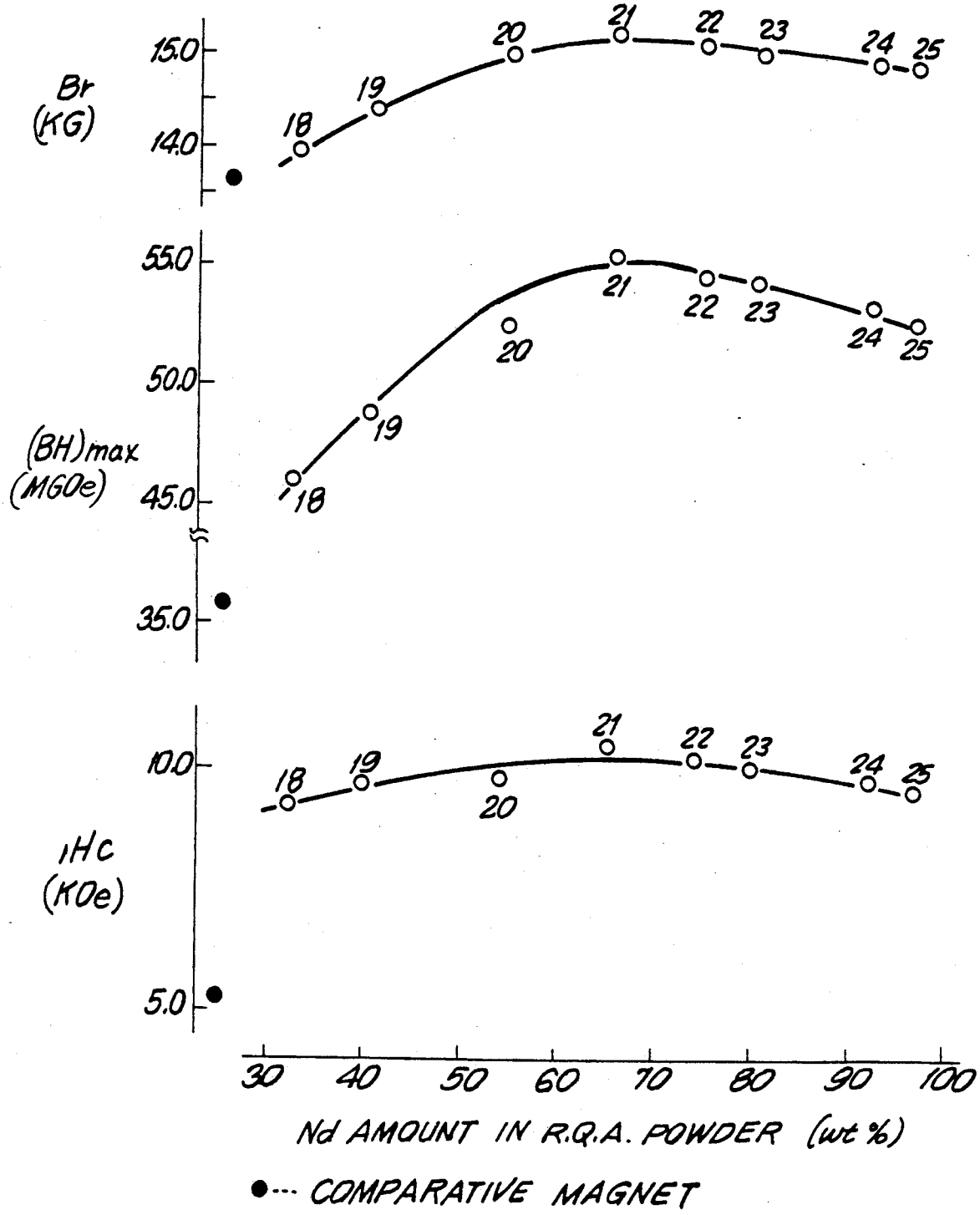
FIG. 3 is a graph showing magnetic properties of sample magnets in Example 3.

It is also understood from FIG. 3 that R-T-B magnet having an improved magnetic properties can be obtained by use of the R.Q.A. powder for the solid solution phase according to the present invention.

EXAMPLE 4

Eight mixtures having different mixing ratio of the R.Q.A. powder but consisting, by weight, of Nd 30%, Co 14.4%, B 1.0%, and the balance Fe by mixing one or more selected from R.Q.A. powders Nos. 1, 2, and 9-14 in Table 2 and one or more M.A. powders Nos. 13-16 in Table 6. Amounts of the R.Q.A. powder in eight mixtures were 10%, 20%, 30%, 40%, 50%, 60%, 70%, and 75% by volume, respectively, as shown in Table 8.

Each of the eight mixtures were finely ground, compacted, and sintered in the similar condition as in Example 1. The sintered body was aged in the similar manner as in Example 3. Magnetic properties (Br, $_IH_C$, (BH)max) of the resultant eight magnets of sample Nos. 26-33 in Table 8 were measured and the measured data are shown in a graph of FIG. 4 where the axis of abscissa represents the volumetric ratio of the R.Q.A. powder in the mixture. In the figure, the magnetic properties of the comparative sample in Example 3 is also shown at black points.

Figure 4:
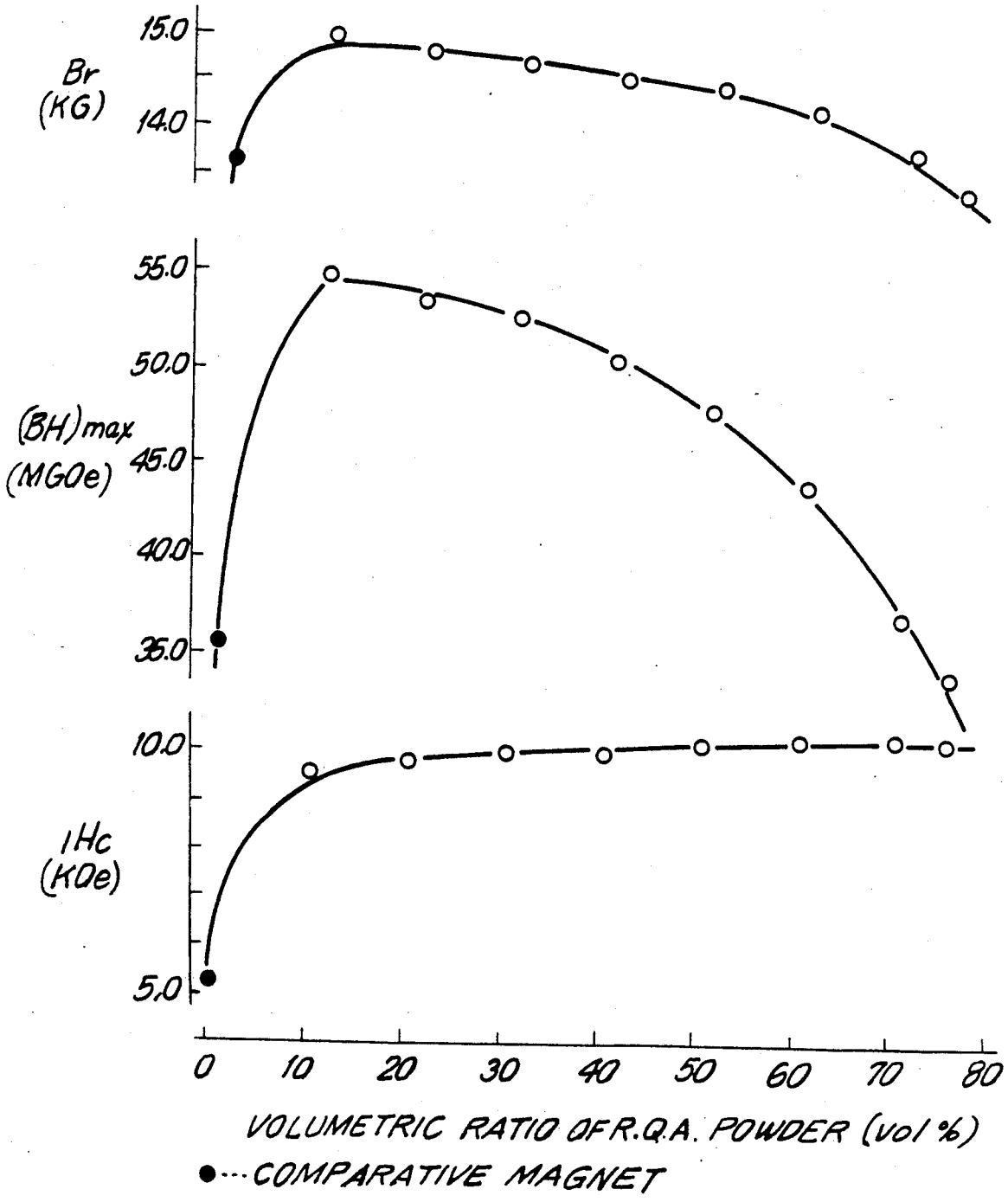
FIG. 4 is a graph showing magnetic properties of sample magnets in Example 4.

It will also be confirmed from FIG. 4 that use of the R.Q.A. powder considerably improves the magnetic properties of Nd-Fe-B permanent magnet.

TABLE 8

| Sample No. | MIXTURE (Nd 30, Co 14.4, B 1.0, Fe bal. (wt %)) M.A. (Vol. %) | R.Q.A. (Vol. %) |
|---|---|---|
| 26 | 90 | 10 |
| 27 | 80 | 20 |
| 28 | 70 | 30 |
| 29 | 60 | 40 |
| 30 | 50 | 50 |
| 31 | 40 | 60 |
| 32 | 30 | 70 |
| 33 | 25 | 75 |

Used M.A. powders; Nos 13-16 in Table 6.
Used R.Q.A. powders; Nos 1, 2, and 9-14 in Table 2.

EXAMPLE 5

Each magnetic powder of those eight Nd-(FeCo)-B M.A. No. 3 in Table 1 and Nos. 18, 15, 19–23 in Table 6 was mixed with the R.Q.A. powder No. 11 in Table 2 to a mixture consisting, by weight, of Nd 30%, B 1.0%, and the balance Fe and/or Co, as shown in Table 9.

TABLE 9

| Sample No. | MIXTURE (Nd 30, B 1.0, (Fe, Co) bal. (wt %)) M.A. (93.6 Vol %) | R.Q.A. (6.4 Vol %) |
|---|---|---|
| 34 | No. 3 | No. 11 |
| 35 | No. 18 | No. 11 |
| 36 | No. 15 | No. 11 |
| 37 | No. 19 | No. 11 |
| 38 | No. 20 | No. 11 |
| 39 | No. 21 | No. 11 |
| 40 | No. 22 | No. 11 |
| 41 | No. 23 | No. 11 |

Figure 5:
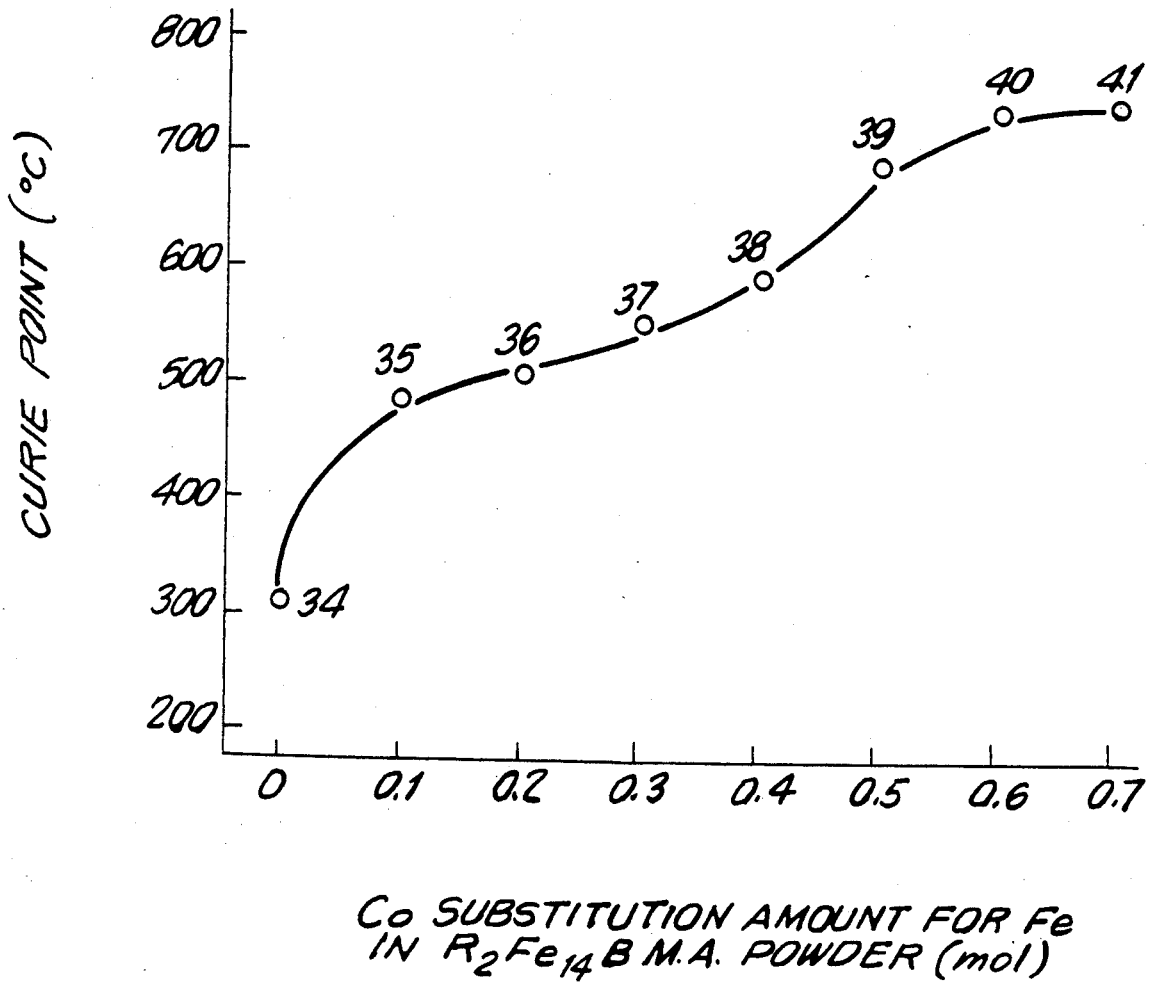
FIG. 5 is a graph showing Curie points of sample magnets in Example 5.

Each mixture was finely ground, compacted, and sintered in the similar manner as in Example 3. The sintered body was subjected to an aging treatment by heating at a temperature of 500°–700 ° C. for one hour and rapidly quenched. Curie temperatures of the resultant sample magnets Nos. 34–41 were measured, and the measured Curie temperatures are shown together with sample numbers in FIG. 5. It will be noted that the Curie temperature elevates by increase of substitution of Co for Fe.

EXAMPLE 6

Thirteen ribbons of R.Q.A. shown in Table 10 were prepared by the continuous splat-quenching method, using starting materials having a purity factor of 95% or more and pulverizing process.

TABLE 10

| Sample NO. | MIXTURE M.A. (88.4 Vol %) | R.Q.A. (bal.) T | Elements in mixture T (wt %) | Fe (wt %) |
|---|---|---|---|---|
| 42 | No. 15 | Ni | Ni 0.7 | bal. |
| 43 | No. 15 | Cr | Cr 0.6 | bal. |
| 44 | No. 15 | V | V 0.6 | bal. |
| 45 | No. 15 | Ti | Ti 0.6 | bal. |
| 46 | No. 15 | Mn | Mn 0.7 | bal. |
| 47 | No. 15 | Cu | Cu 0.7 | bal. |
| 48 | No. 15 | Zn | Zn 0.76 | bal. |
| 49 | No. 15 | Zr | Zr 0.97 | bal. |
| 50 | No. 15 | Nb | Nb 0.9 | bal. |
| 51 | No. 15 | Mo | Mo 1.0 | bal. |
| 52 | NO. 15 | Hf | Hf 1.5 | bal. |
| 53 | No. 15 | Ta | Ta 1.5 | bal. |
| 54 | No. 15 | W | W 1.5 | bal. |

R.Q.A. = Nd 70 wt %, B 1.0 wt %, $(Fe_{0.8} + T_{0.2})$ bal.
Elements in Mixture = Nd 32 wt %, Co 13.3 wt %, B 1.0 wt %, T, and Fe.

Each R.Q.A. powder of 11.6 wt % and M.A. powder of 88.4 wt % No. 15 in Table 6 were mixed with each other. The mixture was finely divided, compacted, and sintered in the similar manner as in Example 1. The sintered body was heated at a temperature of 500°–700° C. for one hour. Thus, magnet samples Nos. 42–54 were obtained as demonstrated in Table 11 together with measured magnetic properties.

TABLE 11

| Sample No. | Br (kG) | $_JH_C$ (kOe) | (BH)max (MGOe) |
|---|---|---|---|
| 42 | 14.0 | 8.1 | 44.0 |
| 43 | 13.8 | 7.5 | 40.0 |
| 44 | 13.9 | 8.3 | 44.2 |

TABLE 11-continued

| Sample No. | Br (kG) | $_JH_C$ (kOe) | (BH)max (MGOe) |
|---|---|---|---|
| 45 | 13.9 | 8.6 | 44.1 |
| 46 | 13.7 | 7.7 | 42.1 |
| 47 | 13.8 | 7.5 | 43.0 |
| 48 | 13.5 | 7.9 | 40.0 |
| 49 | 13.7 | 7.6 | 41.3 |
| 50 | 13.8 | 9.0 | 44.0 |
| 51 | 13.7 | 8.0 | 42.5 |
| 52 | 13.5 | 8.0 | 42.3 |
| 53 | 13.5 | 7.5 | 40.0 |
| 54 | 13.6 | 7.7 | 40.0 |

It will be understood from Table 11 that those samples have excellent magnetic properties.

EXAMPLE 7

M.A. powder of 88.4 wt % of No. 3 in Table 1 and each of R.Q.A. powders of 11.6 wt % were mixed with each other. The mixture was finely ground in a ball mill to have an average particle size of 3–5 μm and then compacted in a magnetic field of 20 kOe under a pressure of 1.06 ton.f/cm$^2$. The compact was sintered in argon atmosphere at a temperature of 1,000°–1,100 ° C. for two hours. The sintered body was heated at a temperature of 500°–700° C. for one hour. Thus, sintered magnets of sample Nos. 55–68 as shown in Table 12 were obtained. The magnetic properties of the magnets are also demonstrated in Table 13.

TABLE 12

| Sample NO. | MIXTURE M.A. (88.4 Vol %) | R.Q.A. (bal.) T | Elements in mixture T (wt %) | Fe (wt %) |
|---|---|---|---|---|
| 55 | No. 3 | Co | Co 0.7 | bal. |
| 56 | No. 3 | Ni | Ni 0.7 | bal. |
| 57 | No. 3 | Cr | Cr 0.6 | bal. |
| 58 | No. 3 | V | V 0.6 | bal. |
| 59 | No. 3 | Ti | Ti 0.6 | bal. |
| 60 | No. 3 | Mn | Mn 0.7 | bal. |
| 61 | No. 3 | Cu | Cu 0.75 | bal. |
| 62 | No. 3 | Zn | Zn 0.76 | bal. |
| 63 | No. 3 | Zr | Zr 0.97 | bal. |
| 64 | No. 3 | Nb | Nb 0.99 | bal. |
| 65 | No. 3 | Mo | Mo 1.0 | bal. |
| 66 | No. 3 | Hf | Hf 1.5 | bal. |
| 67 | No. 3 | Ta | Ta 1.5 | bal. |
| 68 | No. 3 | W | W 1.5 | bal. |

R.Q.A. = Nd 70 wt %, B 1.0 wt %, $(Fe_{0.8} + T_{0.2})$ bal.
Elements in Mixture = Nd 32 wt %, B 1.0 wt %, T, and Fe

TABLE 13

| Sample No. | Br (kG) | $_JH_C$ (kOe) | (BH)max (MGOe) |
|---|---|---|---|
| 55 | 14.0 | 8.5 | 44.5 |
| 56 | 14.0 | 8.9 | 44.0 |
| 57 | 13.8 | 8.1 | 43.1 |
| 58 | 13.9 | 9.0 | 44.5 |
| 59 | 13.9 | 9.0 | 44.0 |
| 60 | 13.5 | 8.0 | 41.3 |
| 61 | 13.6 | 8.1 | 41.0 |
| 62 | 13.5 | 7.9 | 40.0 |
| 63 | 13.6 | 8.0 | 42.3 |
| 64 | 13.8 | 9.5 | 44.0 |
| 65 | 13.6 | 9.0 | 43.5 |
| 66 | 13.5 | 8.2 | 42.1 |
| 67 | 13.3 | 7.8 | 39.0 |
| 68 | 13.5 | 8.3 | 40.0 |

EXAMPLE 8

M.A. powder of No. 23 consisting of Nd 26.7%, B 1.0%, and the balance Fe by weight as shown in Table 14 was prepared in the similar manner in Example 1. While, three R.Q.A. powders Nos. 15–17 as shown in Table 14 were prepared in a form of ribbon in the similar manner as in Example 1.

TABLE 14

| | M.A. | R.Q.A. | | |
|---|---|---|---|---|
| | No. 23 | No. 15 | No. 16 | No. 17 |
| Nd (wt %) | 26.7 | 60.0 | 60.0 | 60.0 |
| B (wt %) | 1.0 | 1.0 | 1.0 | 1.0 |
| Co (wt %) | — | 20.4 | — | — |
| Cu (wt %) | — | — | 12.8 | — |
| Ni (wt %) | — | — | — | 13.1 |
| Fe (wt %) | bal. | bal. | bal. | bal. |

Each R.Q.A. powder and the M.A. powder were blended to have the total Nd amount of 31 wt % in a mixture. Then, each mixture was treated in the similar processes as in Example 1 and three sintered magnets were obtained as samples Nos. 69–71 in Table 15.

TABLE 15

| Sample No. | R.Q.A. No. | MIXTURE (wt %) T | Fe | Br (kG) | (BH)max (MGOe) | $_iH_C$ (kOe) | Test Result |
|---|---|---|---|---|---|---|---|
| 69 | 15 | Co 2.1 | bal. | 15.2 | 52.4 | 7.2 | Good |
| 70 | 16 | Cu 1.3 | bal. | 15.0 | 53.1 | 8.6 | Good |
| 71 | 17 | Ni 1.3 | bal. | 14.9 | 50.1 | 6.9 | Good |
| Comparative | | — | bal. | 13.8 | 33.0 | 7.0 | Bad |

Elements of Mixture = Nd 31 wt %, B 1.0 wt %, T, and Fe

Each sample magnet of Nos. 69–71 and the comparative sample in Example 1 were coated with Ni thin film by the electrolytic plating. Those Ni coatings had a thickness of about 7 μm at minimum and about 25 μm at maximum.

Those samples having the Ni coatings were subjected to a corrosion resistance test where each sample was maintained for 300 hours in an atmosphere of a humidity of 90% and a temperature of 60° C. After the test, no red rust occurred on each sample of Nos. 69–71, but red rust and/or flaking of Ni plating occurred on the comparative sample.

EXAMPLE 9

From starting materials of Dy having a purity factor of 95% or more and Fe and B having a purity factor of 99% or more, nine R.Q.A. Nos. 18–26 shown in Table 16 were prepared in a form of ribbon by the similar R.Q.A. producing method in Example 1. Each of R.Q.A. ribbons was pulverized into an R.Q.A. powder.

TABLE 16

| | R.Q.A. No. | | | | |
|---|---|---|---|---|---|
| | 18 | 19 | 20 | 21 | 22 |
| Dy (wt. %) | 32.0 | 40.0 | 50.0 | 60.0 | 65.0 |
| B (wt. %) | 1.0 | 1.0 | 1.0 | 1.0 | 1.0 |
| Fe (wt. %) | bal. | bal. | bal. | bal. | bal. |
| | R.Q.A. No. | | | | |
| | 23 | 24 | 25 | 26 | |
| Dy (wt. %) | 70.0 | 80.0 | 90.0 | 97.0 | |
| B (wt. %) | 1.0 | 1.0 | 1.0 | 1.0 | |
| Fe (wt. %) | bal. | bal. | bal. | bal. | |

Each R.Q.A. powder of Nos. 18–21 and 23–26 in Table 16 was mixed with one or more selected from M.A. powders Nos. 1–3, 5, and 6 in Table 1 with mixing ratio of 8 to 92 by volume so that the mixture consisted, by weight of (Nd+Dy) 30%, B 1.0%, and the balance Fe, as shown in Table 17. Each of the resultant eight mixtures were finely ground in ball mill to have an average particle size of 3–5 um and was then compacted in a magnetic field of 10 kOe under a pressure of 1.0 ton.f/cm$^2$. The compact was sintered in a sintering furnace having argon atmosphere at a temperature of 1,000°–1,200 ° C. for 2 hours or less, then cooled in the furnace. The sintered body was aged by heating at a temperature of 500°–700 ° C. for 1–5 hours and then rapidly quenching. Magnetic properties of the resultant magnets Nos. 72–79 were measured and were shown together with amorphous numbers on curves A in FIG. 6.

TABLE 17

| | Sample No. | | | | | | | |
|---|---|---|---|---|---|---|---|---|
| | 72 | 73 | 74 | 75 | 76 | 77 | 78 | 79 |
| R.Q.A. No. | 18 | 19 | 20 | 21 | 23 | 24 | 25 | 26 |
| MIXTURE | (Nd + Dy) = 30 wt %, B = 1.0 wt %, Fe = bal. | | | | | | | |

Used M.A. powder = Nos. 1, 2, 3, 5, and 6 in Table 1.
Amount of M.A. powder = 92 vol %.
Amount of R.Q.A. powder = 8 vol %.

As comparative samples, eight ingots of alloys comprising (Nd+Dy) 30 wt %, B 1.0 wt %, and the balance Fe similar to the above-described eight mixtures were prepared and pulverized and finely divided into powders. Each of those powders was compacted, sintered, and aged in the above-described condition. Magnetic properties were also shown on curves B in FIG. 6.

Oxygen contained in sample magnet No. 76 was measued as 1,780 ppm, but the comparative magnet comprising similar elements was measured to contain oxygen of 2,790 ppm.

EXAMPLE 10

Sample magnets containing Pr in place of Dy in Example 9 were produced in the similar manner in Example 9. Magnetic properties of those sample magnets are also shown in FIG. 7 together with comparative samples also containing Pr in place of Dy.

EXAMPLE 11

Figure 8:
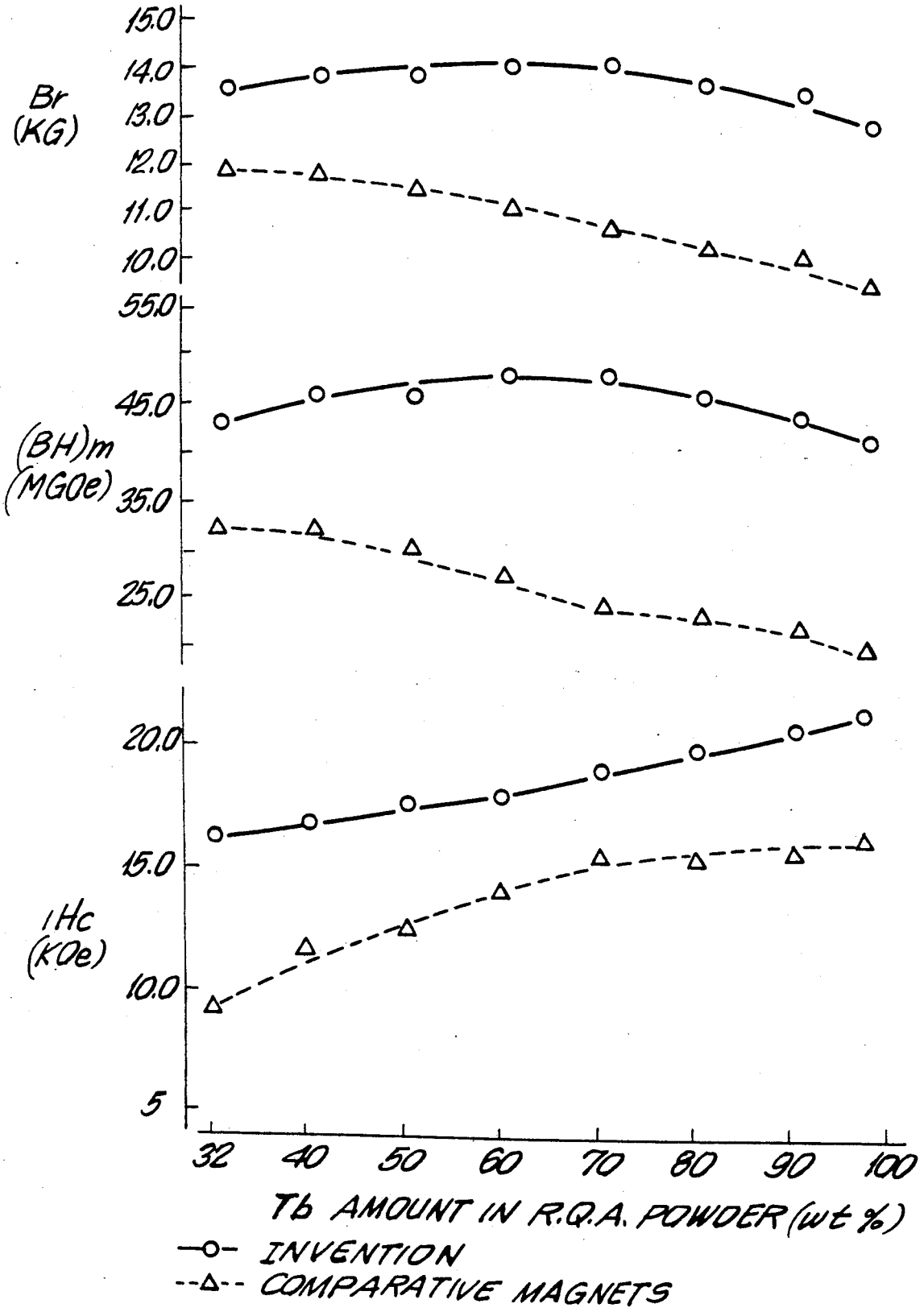
FIG. 8 is a graph showing magnetic properties of sample magnets in Example 11.

In the similar manner, sample magnets containing Tb in place of Dy in Example 9 were produced and magnetic properties of them are shown in FIG. 8.

Figure 6:
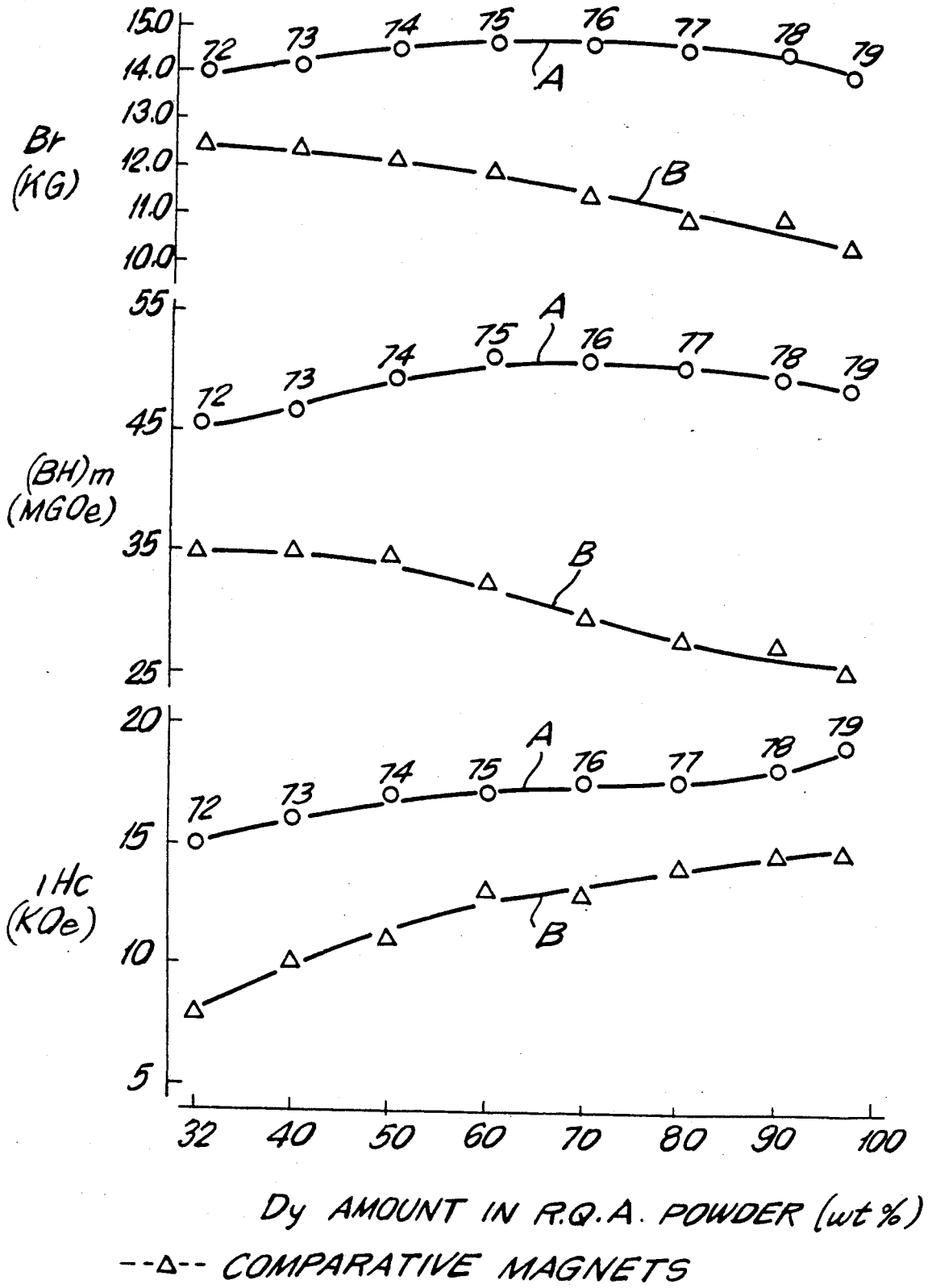
FIG. 6 is a graph showing magnetic properties of sample magnets in Example 9.
Figure 7:
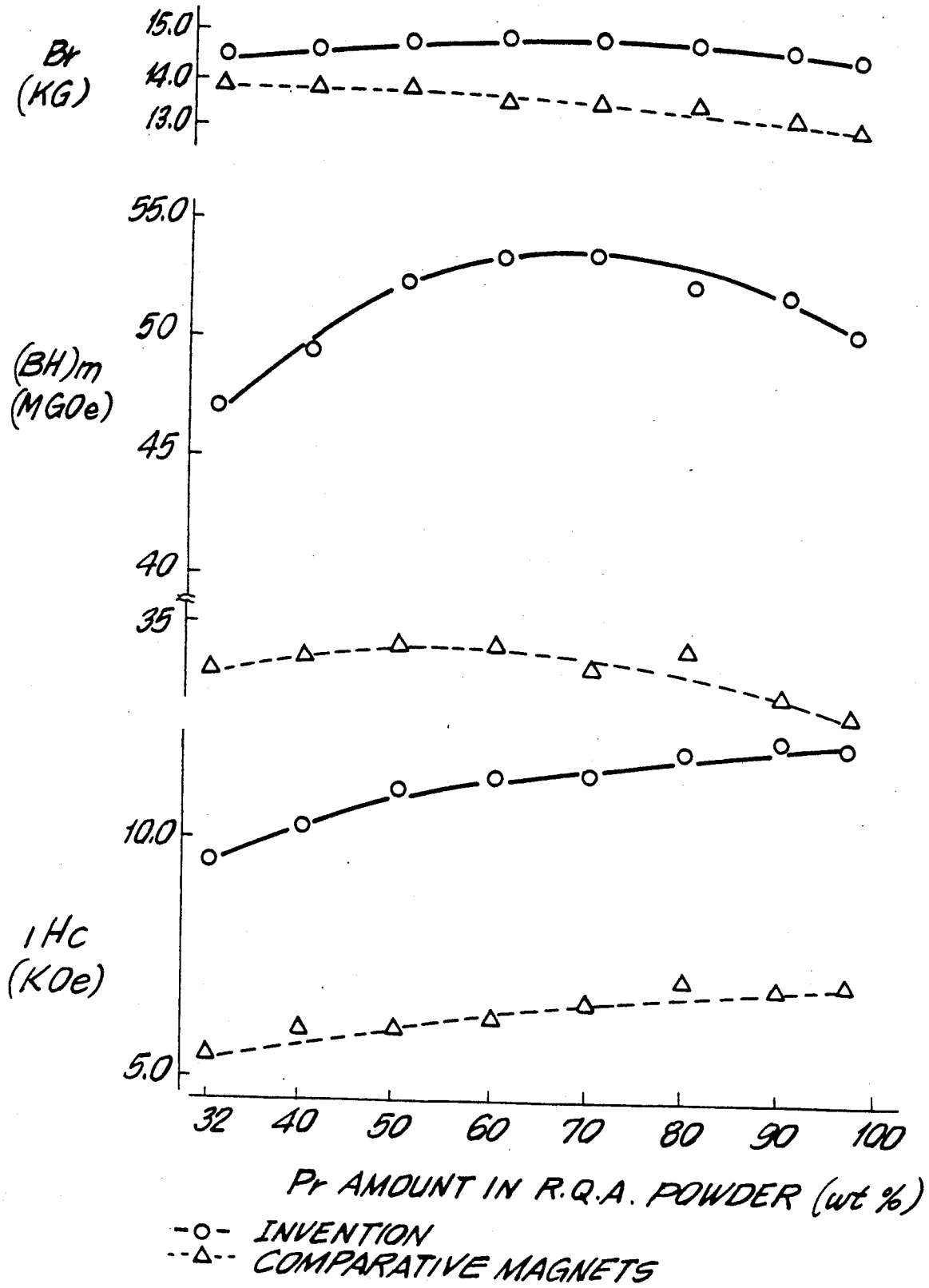
FIG. 7 is a graph showing magnetic properties of sample magnets in Example 10.

It will be noted from FIGS. 6–8 that magnets using R.Q.A. powder have magnetic properties superior to magnets produced by use of only powders of alloy ingots.

EXAMPLE 12

Figure 9:
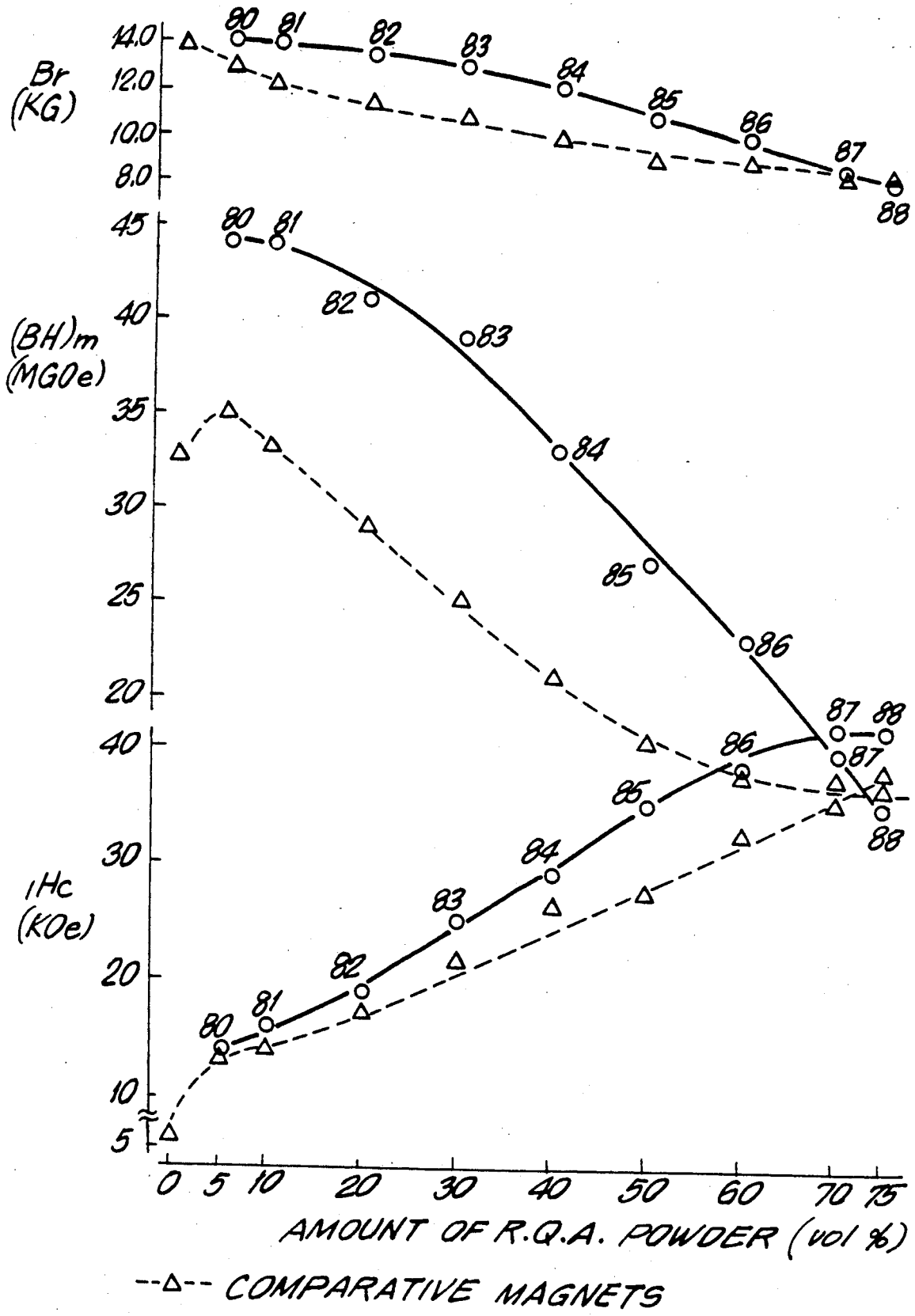
FIG. 9 is a graph showing magnetic properties of sample magnets in Example 12.

One or more M.A. powders selected from M.A. powders Nos. 1, 2, 3, 5, and 6 in Table 1 and R.Q.A. powder No. 18 in Table 16 are mixed with different mixing ratio as shown in Table 18 to prepare different nine mixtures but each mixture containing Nd+Dy 30 wt. %, B 1.0 wt. %, and Fe balance. Each mixture was ground, compacted, sintered, and aged in the similar conditions as in Example 9 and nine magnet samples Nos. 80–88 were produced. The magnetic properties of the resultant magnets are shown in FIG. 9 together with sample numbers 80–81.

TABLE 18

| Sample No. | MIXTURE ((Nd + Dy) 30 wt %, B 1.0 wt %, Fe bal.) M.A. (Vol %) | R.Q.A. (Vol %) |
|---|---|---|
| 80 | 95 | 5 |
| 81 | 90 | 10 |
| 82 | 80 | 20 |
| 83 | 70 | 30 |
| 84 | 60 | 40 |
| 85 | 50 | 50 |
| 86 | 40 | 60 |
| 87 | 30 | 70 |
| 88 | 25 | 75 |

Used M.A. powder = Nos. 1, 2, 3, 5, and 6 in Table 1.
Used R.Q.A. powder = No. 18 in Table 16.

For comparison, nine alloy ingots containing elements similar to the nine mixtures were prepared and pulverized to obtain nine different alloy powders. Those ingot powders were ground, compacted, sintered, and aged in the similar manner as the sample magnets 80–88 and nine comparative magnets were obtained. The magnetic properties of those comparative magnets are also shown by dashed lines in FIG. 9.

It will be understood from FIG. 9 that magnets using R.Q.A. powders of 70 vol. % or less according to the present invention have excellent magnetic properties superior to comparative magnets using only ingot powders.

EXAMPLE 13

Each of R.Q.A. powders Nos. 18–26 in Table 16 were mixed with one or more M.A. powders 13–16 in Table 6 with a mixing ratio of 8 to 92 by volume, as shown in Table 19, so that each mixture contains Nd+Dy 30 wt. %, B 1.0 wt. %, Co 14.4 wt. %, and Fe balance. Each mixture was ground, compacted, and sintered in the similar manner as in Example 9. The sintered body was aged at a temperature of 500°–700° C. for two hours and sample magnets Nos. 89–96 were obtained. The magnetic properties of the sample magnets were measured and are shown together with sample numbers 89–96 in FIG. 10.

TABLE 19

| | Sample No. | | | | | | | |
|---|---|---|---|---|---|---|---|---|
| | 89 | 90 | 91 | 92 | 93 | 94 | 95 | 96 |
| R.Q.A. No. | 18 | 19 | 20 | 21 | 23 | 24 | 25 | 26 |
| MIXTURE | (Nd + Dy) 30 wt %, Co 14.4 wt %, B 1.0 wt %, Fe bal. | | | | | | | |

Used M.A. powder = Nos. 13–16 in Table 6.
Amount of M.A. powder = 92 vol. %.
Amount of R.Q.A. powder = 8 vol. %.

Eight comparative magnets were prepared from alloy ingots having elements similar to the sample magnets 89–96 by the sintering method. The magnetic properties of the comparative magnets are also shown by dashed lines in FIG. 10.

EXAMPLE 14

Tb was used in place of Dy in sample magnets 89–96 and comparative magnets in Example 13. The magnetic properties of the resultant magnets are shown in FIG. 11.

Figure 10:
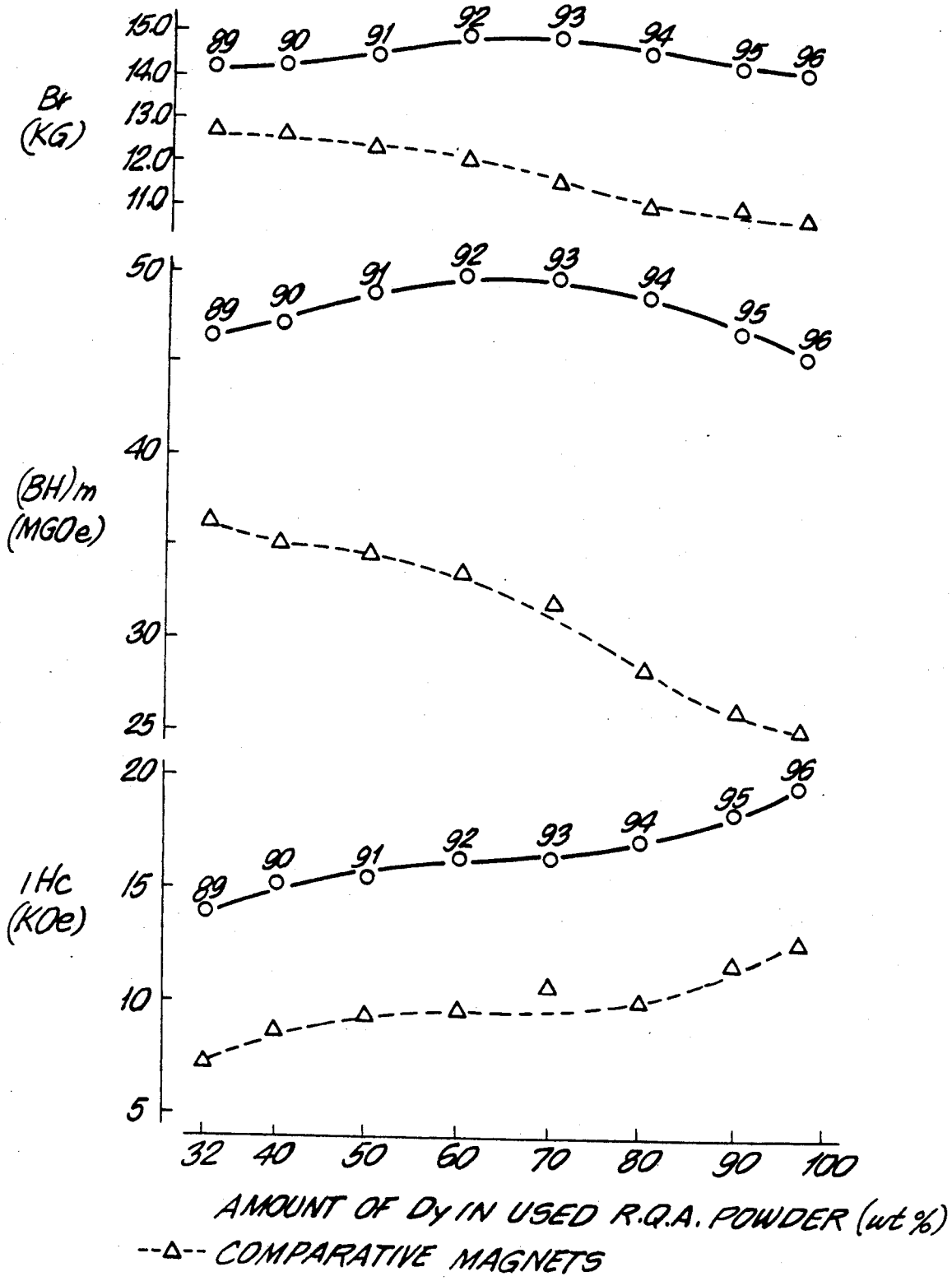
FIG. 10 is a graph showing magnetic properties of sample magnets in Example 13.
Figure 11:
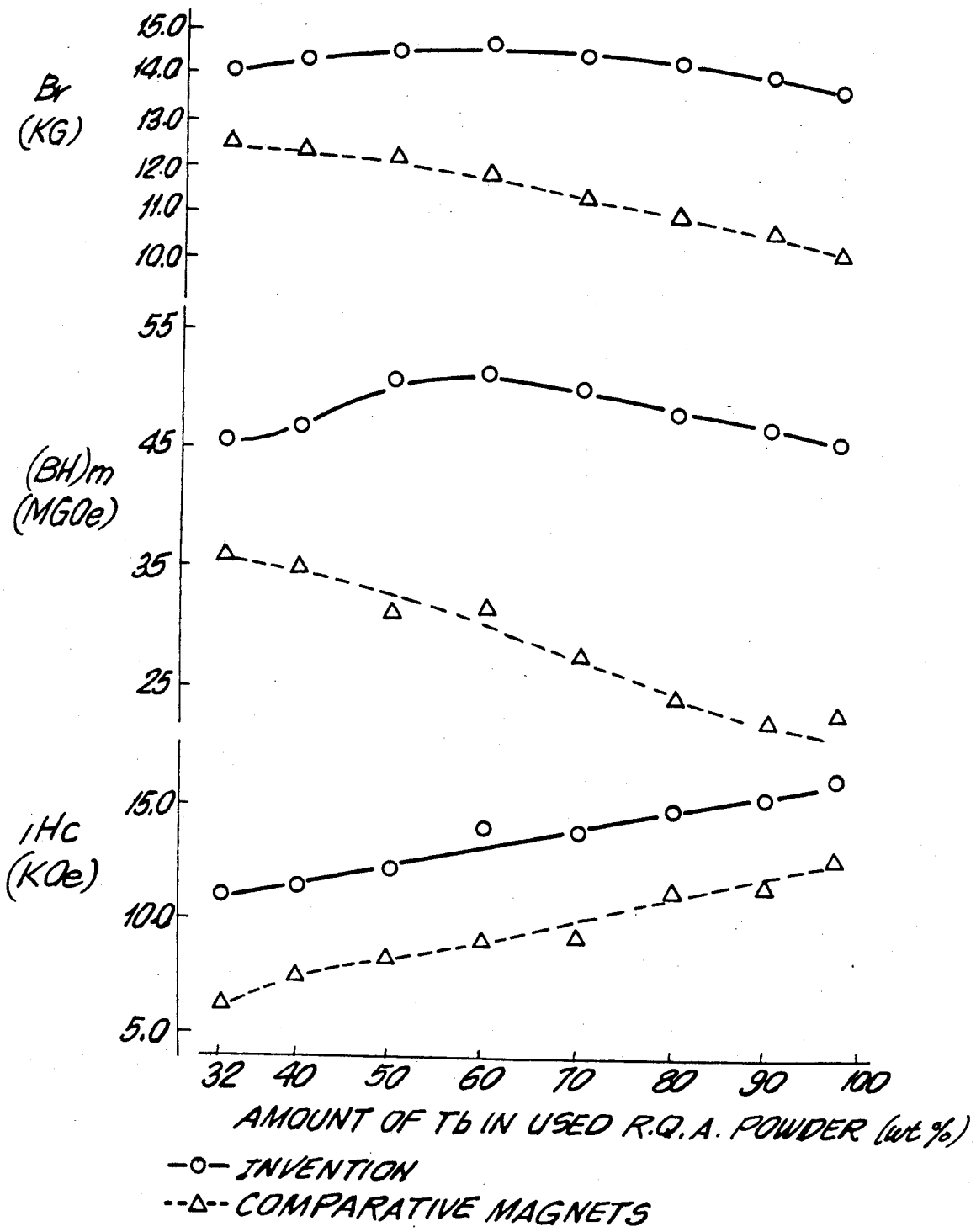
FIG. 11 is a graph showing magnetic properties of sample magnets in Example 14.

FIGS. 10 and 11 teach us that use of R.Q.A. powders improves the magnetic properties of sintered magnets.

EXAMPLE 15

R.Q.A. powder No. 18 in Table 16 was mixed with one or more of M.A. powders Nos. 1–3, 5, and 6 in Table 1 with mixing ration as shown in Table 20 so that each mixture contains Nd+Dy 30 wt. %, B 1.0 wt. %, and Fe balance.

TABLE 20

| Sample No. | MIXTURE ((Nd+ Dy) 30 wt %, B 1.0 wt %, Fe bal.) M.A. (Vol %) | R.Q.A. (Vol %) |
|---|---|---|
| 97 | 95 | 5 |
| 98 | 90 | 10 |
| 99 | 80 | 20 |
| 100 | 70 | 30 |
| 101 | 60 | 40 |
| 102 | 50 | 50 |
| 103 | 40 | 60 |
| 104 | 30 | 70 |
| 105 | 25 | 75 |

Used M.A. powder = Nos. 1, 2, 3, 5, and 6 in Table 1.
Used R.Q.A. powder = No. 18 in Table 16.

Each mixture was ground, compacted, sintered, and aged in the similar conditions as in Example 9 and samples magnets Nos. 97–105 were obtained. The magnetic properties of the sample magnets Nos. 97–105 are shown together with sample numbers in FIG. 12.

Figure 12:
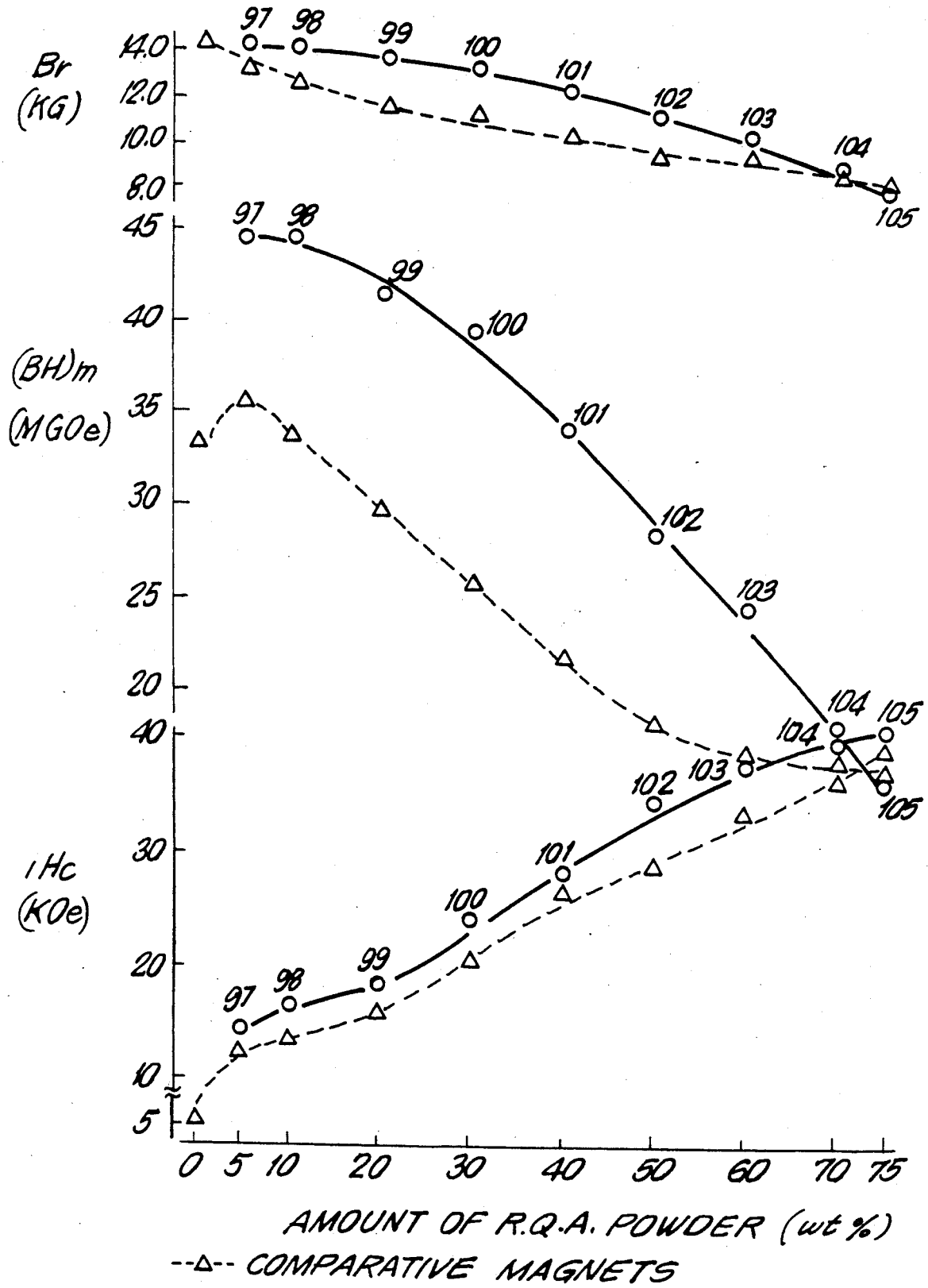
FIG. 12 is a graph showing magnetic properties of sample magnets in Example 15.

FIG. 12 also shows, by dashed lines, magnetic properties of comparative magnets which were produced from alloy ingots comprising elements similar to sample magnets Nos. 97–105.

It is also noted in this Example that use of R.Q.A. powder improves the magnetic properties of the R-Fe-B sintered magnets.

EXAMPLE 16

Each of M.A. powders No. 3 in table 1 and Nos. 18, 15, and 19–21 in Table 6 was mixed with R.Q.A. powder No. 22 in Table 16 with mixing ratio 92.1 to 7.9 by volume, as shown in Table 21. Each mixture was ground, compacted, sintered, and aged under conditions similar to Example 9 and sample magnets 106–111 were obtained.

TABLE 21

| | Sample No. | | | | | |
|---|---|---|---|---|---|---|
| | 106 | 107 | 108 | 109 | 110 | 111 |
| M.A. No. | 3 | 18 | 15 | 19 | 20 | 21 |
| MIXTURE | (Nd + Dy) 30 wt %, B 1.0 wt %, (Fe + Co) bal. | | | | | |

Amount of M.A. powder = 92.1 vol. %.
Used R.Q.A. powder = No. 22 in Table 16.
Amount of R.Q.A. powder = 7.9 vol. %.

Figure 13:
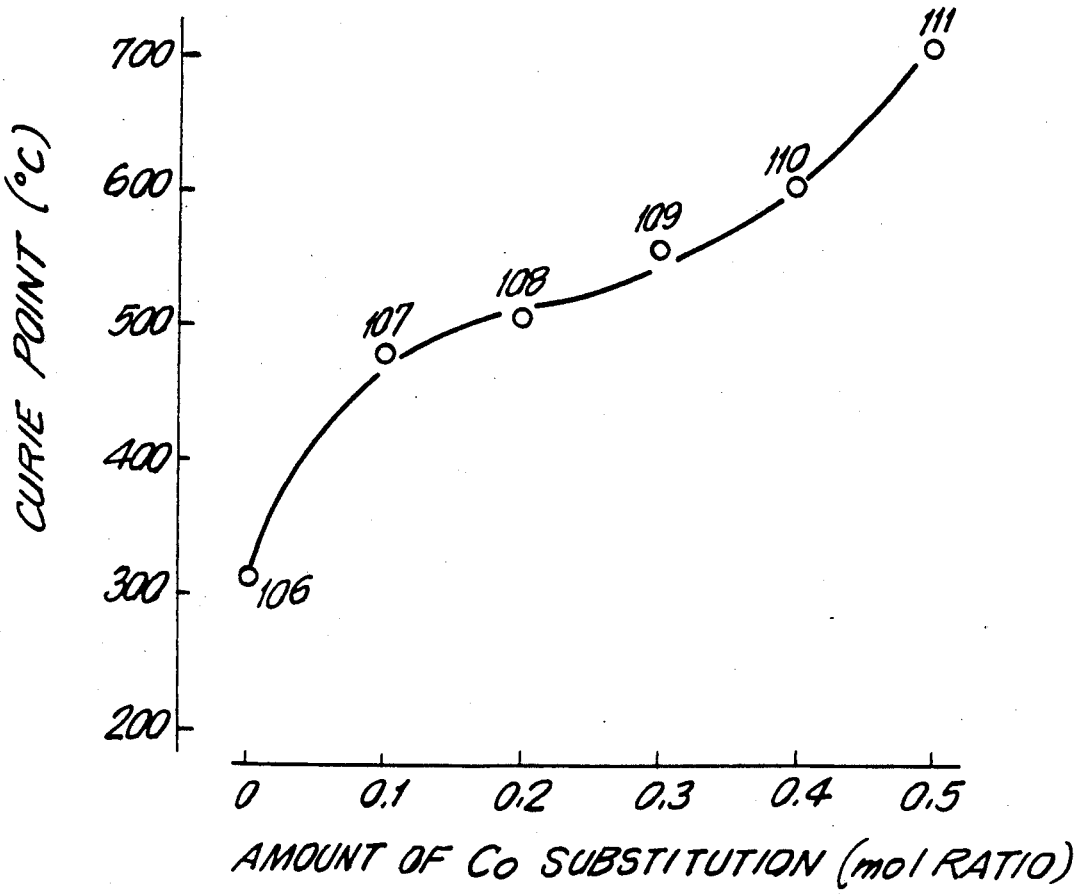
FIG. 13 is a graph showing Curie points of sample magnets in Example 16.

Curie points of the sample magnets 106–111 were measured and are shown in FIG. 13 together with the sample numbers.

In FIG. 13, an axis of abscissa represents Co substitution atomic ratio for Fe in M.A. powder. It will be noted from FIG. 13 that increase of Co substitution ratio elevates the Curie point of the magnet.

EXAMPLE 17

In order to examine distribution of Dy concentration in the magnet, microanalysis was carried out at spots positioned at different distances from the surface of an $R_2Fe_{14}B$ crystal particle in sample magnet No. 76 in Table 17. The analysis elements are shown in Table 22.

Figure 14:
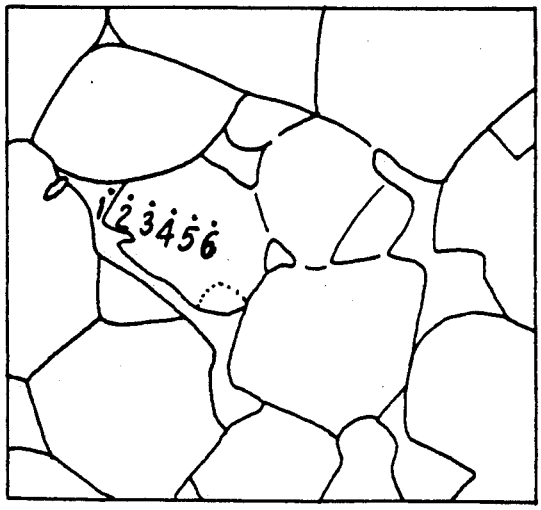
FIG. 14 shows a microstructure of a sample magnet in Example 17 together with microanalyzed positions.

FIG. 14 shows a microstructure of the magnet No. 76 together with microanalyzed positions.

Table 22 teaches us that Dy concentrates in the vicinity of the $R_2Fe_{14}B$ particle surface.

TABLE 22

| Measured Position | Position No. | Analysis elements (wt %) Nd | Dy | Fe |
|---|---|---|---|---|
| R—Fe solid solution | 1 | 1.9 | 85.0 | 13.1 |
| 1 μm inside from $R_2Fe_{14}B$ particle surface | 2 | 3.2 | 25.0 | 62.5 |
| 3 μm inside from $R_2Fe_{14}B$ particle surface | 3 | 6.8 | 20.6 | 72.6 |
| 5 μm inside from $R_2Fe_{14}B$ particle surface | 4 | 13.5 | 12.2 | 74.3 |
| 7 μm inside from $R_2Fe_{14}B$ particle surface | 5 | 20.7 | 3.1 | 76.2 |
| 9 μm inside from $R_2Fe_{14}B$ particle surface | 6 | 26.9 | 0.2 | 72.9 |

EXAMPLE 18

R.Q.A. powders Nos. 27–41 shown in Table 23 were prepared in the similar producing processes as R.Q.A. powders Nos. 1–14 in Table 2 by the continuous splat-quenching method.

TABLE 23

| R.Q.A. No. | Elements (wt. %) Nd | B | Co | Ni | Cu | Pb | Sn | Fe |
|---|---|---|---|---|---|---|---|---|
| 27 | 60.0 | 1.0 | 10.0 | — | — | — | — | bal. |
| 28 | 55.0 | 1.0 | 29.0 | — | — | — | — | bal. |
| 29 | 50.0 | 1.0 | 40.0 | — | — | — | — | bal. |
| 30 | 43.0 | 1.0 | 50.0 | — | — | — | — | bal. |
| 31 | 60.0 | 1.0 | — | 10.0 | — | — | — | bal. |
| 32 | 57.0 | 1.0 | — | 18.0 | — | — | — | bal. |
| 33 | 50.0 | 1.0 | — | 40.0 | — | — | — | bal. |
| 34 | 60.0 | 1.0 | — | — | 10.0 | — | — | bal. |
| 35 | 60.0 | 1.0 | — | — | 21.0 | — | — | bal. |
| 36 | 45.0 | 1.0 | — | — | 39.0 | — | — | bal. |
| 37 | 60.0 | 1.0 | — | — | — | 10.0 | — | bal. |
| 38 | 60.0 | 1.0 | — | — | — | 17.0 | — | bal. |
| 39 | 60.0 | 1.0 | — | — | — | 25.0 | — | bal. |
| 40 | 60.0 | 1.0 | — | — | — | — | 10.0 | bal. |
| 41 | 60.0 | 1.0 | — | — | — | — | 15.0 | bal. |

TABLE 24

| Sample No. | Used R.Q.A. No. | Vol. % | Mixture elements (wt %) Nd | B | T | Fe |
|---|---|---|---|---|---|---|
| 112 | 27 | 10.2 | 30.0 | 1.0 | Co = 0.99 | bal. |
| 113 | 28 | 11.6 | 30.0 | 1.0 | Co = 3.4 | bal. |
| 114 | 29 | 13.8 | 30.0 | 1.0 | Co = 5.64 | bal. |
| 115 | 30 | 19.4 | 30.0 | 1.0 | Co = 10.1 | bal. |
| 116 | 31 | 10.2 | 30.0 | 1.0 | Ni = 0.99 | bal. |
| 117 | 32 | 10.9 | 30.0 | 1.0 | Ni = 1.97 | bal. |
| 118 | 33 | 13.8 | 30.0 | 1.0 | Ni = 5.64 | bal. |
| 119 | 34 | 10.2 | 30.0 | 1.0 | Cu = 0.99 | bal. |
| 120 | 35 | 9.9 | 30.0 | 1.0 | Cu = 2.1 | bal. |
| 121 | 36 | 17.5 | 30.0 | 1.0 | Cu = 7.02 | bal. |
| 122 | 37 | 9.9 | 30.0 | 1.0 | Pb = 0.99 | bal. |
| 123 | 38 | 9.6 | 30.0 | 1.0 | Pb = 1.7 | bal. |
| 124 | 39 | 9.3 | 30.0 | 1.0 | Pb = 2.5 | bal. |
| 125 | 40 | 10.3 | 30.0 | 1.0 | Sn = 0.99 | bal. |
| 126 | 41 | 10.4 | 30.0 | 1.0 | Sn = 1.49 | bal. |
| Comparative | | 0 | 30.0 | 1.0 | — | bal. |

Used M.A. powder = No. 23 in Table 14.

Each R.Q.A. powders Nos. 27–41 were mixed with M.A. powder No. 23 in Table 14 with respective mixing ratios as shown in Table 24 to produce fifteen mixtures. Each mixture was ground, compacted, and sintered under the similar conditions as in Example 9. The sintered body was aged at a temperature of 400°–800° C. for a time period of 0.5–10 hours. The resultant sample magnets Nos. 112–126 have magnetic properties shown in Table 25.

With respect to each sample magnet of Nos. 112–126, two test pieces having a size of 10 mm×10 mm×8 mm were formed. Ni-plating and Zn-chromating (or chromate treatment) were applied onto two test pieces, respectively, after Cu plating as a base plating. Those test pieces were subjected to a humidity test where test pieces were maintained at a temperature of 60° C. and a humidity of 90% for 300 hours. After the test, the surfaces of test pieces were observed. The observed results are shown in Table 25. In Table 25, a mark ◎ represents no surface change, another mark○being occurrence of slight red rust at corner portions, another mark Δ being for occurrence of spot-like red rust, and the other mark X for occurrence of red rust on entire surface.

TABLE 25

| Sample No. | Br (kG) | (BH)max (MGOe) | $_iH_C$ (kOe) | Anti-corrosion Test Ni-plating | Zn-chromating |
|---|---|---|---|---|---|
| 112 | 15.1 | 54.0 | 9.3 | ○ | × |
| 113 | 15.2 | 54.0 | 8.5 | ◎ | Δ |
| 114 | 15.2 | 53.0 | 8.0 | ◎ | Δ |
| 115 | 15.0 | 52.0 | 7.3 | ◎ | ○ |
| 116 | 14.9 | 53.0 | 8.6 | ○ | × |
| 117 | 14.7 | 48.0 | 7.8 | ○ | Δ |
| 118 | 14.4 | 45.0 | 7.5 | ◎ | ○ |
| 119 | 14.8 | 46.0 | 8.0 | Δ | × |
| 120 | 14.2 | 44.0 | 7.7 | ○ | Δ |
| 121 | 13.8 | 42.0 | 7.3 | ◎ | ○ |
| 122 | 14.9 | 52.0 | 8.3 | Δ | × |
| 123 | 14.5 | 46.0 | 7.7 | ○ | × |
| 124 | 14.0 | 43.0 | 7.2 | ◎ | Δ |
| 125 | 14.9 | 53.0 | 9.0 | Δ | × |
| 126 | 14.6 | 49.0 | 8.7 | Δ | × |
| Comp. | 13.8 | 40.5 | 7.0 | × | × |

Comparative magnet was prepared from an ingot comprising Nd 30 wt. %, B 1.0 wt. %, and Fe balance as shown in Table 24, and its magnetic properties and humidity test result are shown in Table 25.

It is understood from Table 25 that the sample magnets according to the present invention are superior to the comparative magnet in the magnetic properties and the corrosion resistance.

Distribution of concentration of each elements in sample magnet Nos. 120 and 123 was measured in the similar manner as in Example 17, and are shown in Tables 26 and 27, respectively.

It will be understood from Tables 26 and 27 that Cu and Pb concentrate in the vicinity of the surface of $Nd_2Fe_{14}B$ crystal particle.

TABLE 26

| Measured Position | Position No. | Analysis elements (wt %) Nd | Cu | Fe |
|---|---|---|---|---|
| Nd—Fe—T solid solution | 1 | 75.0 | 19.1 | 5.9 |
| 1 μm inside from $Nd_2Fe_{14}B$ particle surface | 2 | 26.6 | 5.0 | 68.4 |
| 3 μm inside from $Nd_2Fe_{14}B$ particle surface | 3 | 28.2 | 1.4 | 70.4 |
| 5 μm inside from $Nd_2Fe_{14}B$ particle surface | 4 | 26.5 | 0 | 73.5 |
| 7 μm inside from $Nd_2Fe_{14}B$ particle surface | 5 | 27.4 | 0 | 72.6 |

TABLE 27

| Measured Position | Position No. | Anlysis elements (wt %) Nd | Pb | Fe |
|---|---|---|---|---|
| Nd—Fe—T solid solution | 1 | 72.4 | 20.3 | 7.3 |
| 1 μm inside from $Nd_2Fe_{14}B$ particle surface | 2 | 26.8 | 0 | 73.2 |
| 3 μm inside from $Nd_2Fe_{14}B$ particle surface | 3 | 28.3 | 0 | 71.7 |
| 5 μm inside from $Nd_2Fe_{14}B$ particle surface | 4 | 24.3 | 0 | 75.7 |
| 7 μm inside from $Nd_2Fe_{14}B$ particle surface | 5 | 26.1 | 0 | 73.9 |

EXAMPLE 19

R.Q.A powders Nos. 42–51 shown in Table 28 were prepared in the similar producing manner as the above-described R.Q.A. powders by the continuous splat-quenching method.

TABLE 28

| R.Q.A. No. | Elements (wt. %) Nd | B | Co | Ni | Cu | Pb | Sn | Fe |
|---|---|---|---|---|---|---|---|---|
| 42 | 60.0 | 1.0 | 20.0 | — | 10.0 | — | — | bal. |
| 43 | 40.0 | 1.0 | 50.0 | — | — | — | 5.0 | bal. |
| 44 | 60.0 | 1.0 | — | — | — | 5.0 | 5.0 | bal. |
| 45 | 50.0 | 1.0 | — | — | 20.0 | 10.0 | — | bal. |
| 46 | 50.0 | 1.0 | — | 20.0 | 10.0 | — | — | bal. |
| 47 | 50.0 | 1.0 | — | 20.0 | — | — | 5.0 | bal. |
| 48 | 50.0 | 1.0 | — | 15.0 | — | 10.0 | — | bal. |
| 49 | 60.0 | 1.0 | — | — | 10.0 | 5.0 | 5.0 | bal. |
| 50 | 60.0 | 1.0 | 10.0 | — | 6.0 | — | 5.0 | bal. |
| 51 | 50.0 | 1.0 | — | 15.0 | 6.0 | 3.0 | — | bal. |

Each of R.Q.A. powders Nos. 42–51 was mixed with M.A. powders No. 23 in Table 4 as shown in Table 29. Sample magnets Nos. 127–136 were prepared from the resultant mixtures in the similar manner as in Example 18. Test pieces of each magnet were applied with plating and subjected to the humidity test in the similar condition as in Example 18.

TABLE 29

| Sample No. | Used R.Q.A. No. | Vol. % | Mixture elements (wt %) Nd | B | T | Fe |
|---|---|---|---|---|---|---|
| 127 | 42 | 9.9 | 30.0 | 1.0 | Co = 1.98 Cu = 0.99 | bal. |
| 128 | 43 | 23.9 | 30.0 | 1.0 | Co = 1.24 Sn = 1.24 | bal. |
| 129 | 44 | 10.1 | 30.0 | 1.0 | Sn = 0.5 Pb = 0.5 | bal. |
| 130 | 45 | 13.5 | 30.0 | 1.0 | Cu = 2.82 Pb = 1.41 | bal. |
| 131 | 46 | 13.9 | 30.0 | 1.0 | Cu = 1.41 Ni = 2.82 | bal. |
| 132 | 47 | 14.1 | 30.0 | 1.0 | Ni = 2.82 Sn = 0.7 | bal. |
| 133 | 48 | 13.5 | 30.0 | 1.0 | Ni = 2.82 Pb = 1.41 | bal. |
| 134 | 49 | 9.9 | 30.0 | 1.0 | Cu = 0.99 Sn = 0.5 Pb = 0.5 | bal. |
| 135 | 50 | 10.1 | 30.0 | 1.0 | Co = 0.99 Sn = 0.5 Cu = 0.59 | bal. |
| 136 | 51 | 9.8 | 30.0 | 1.0 | Ni = 1.49 Cu = 0.59 Pb = 0.3 | bal. |
| Comparative | | 0 | 30.0 | 1.0 | — | bal. |

Used M.A. powder = No. 23 in Table 4.

The magnetic properties and the test results are shown in Table 30. For comparison, the data of comparative magnet in Example 18 are also shown in Tables 29 and 30.

TABLE 30

| Sample No. | Br (kG) | (BH)max (MGOe) | $_iH_C$ (kOe) | Anti-corrosion Test Ni-plating | Zn-chromating |
|---|---|---|---|---|---|
| 127 | 14.8 | 49.4 | 8.5 | ◎ | Δ |
| 128 | 14.7 | 46.7 | 6.0 | ◎ | O |
| 129 | 14.7 | 49.2 | 8.5 | Δ | X |
| 130 | 14.3 | 46.0 | 7.9 | ● | X |
| 131 | 14.0 | 43.3 | 7.5 | ◎ | O |
| 132 | 14.2 | 44.4 | 7.5 | ◎ | X |
| 133 | 13.9 | 42.0 | 8.0 | ◎ | O |
| 134 | 14.7 | 49.0 | 9.1 | O | X |
| 135 | 14.8 | 49.2 | 8.3 | O | X |
| 136 | 14.0 | 43.5 | 7.6 | ◎ | Δ |
| Comp. | 13.8 | 40.5 | 7.0 | X | X |

Distribution of concentration of each elements in sample magnet Nos. 131 and 135 was also measured in the similar manner as in Example 18, and are shown in Tables 31 and 32, respectively.

TABLE 31

| Measured Position | Position No. | Anlysis elements (wt %) Nd | Cu | Ni | Fe |
|---|---|---|---|---|---|
| Nd—Fe—T solid solution | 1 | 78.2 | 13.2 | 6.8 | 1.8 |
| 1 μm inside from $Nd_2Fe_{14}B$ particle surface | 2 | 24.4 | 2.1 | 3.1 | 70.4 |
| 3 μm inside from $Nd_2Fe_{14}B$ particle surface | 3 | 26.6 | 0 | 0.8 | 72.6 |
| 5 μm inside from $Nd_2Fe_{14}B$ particle surface | 4 | 28.3 | 0 | 0.2 | 71.5 |
| 7 μm inside from $Nd_2Fe_{14}B$ particle surface | 5 | 27.3 | 0 | 0 | 72.7 |

TABLE 32

| Measured Position | Position No. | Anlysis elements (wt %) Nd | Sn | Cu | Co | Fe |
|---|---|---|---|---|---|---|
| Nd—Fe—T solid solution | 1 | 83.4 | 4.3 | 5.5 | 2.1 | 4.7 |
| 1 μm inside from $Nd_2Fe_{14}B$ particle surface | 2 | 25.3 | 0 | 0.3 | 1.3 | 73.1 |
| 3 μm inside from $Nd_2Fe_{14}B$ particle surface | 3 | 26.9 | 0 | 0 | 0.6 | 72.5 |
| 5 μm inside from $Nd_2Fe_{14}B$ particle surface | 4 | 26.7 | 0 | 0 | 0.1 | 73.2 |
| 7 μm inside from $Nd_2Fe_{14}B$ particle surface | 5 | 28.1 | 0 | 0 | 0 | 71.9 |

It will also be understood from Tables 31 and 32 that Cu, Ni, Sn, and Co concentrate in the vicinity of the surface of $Nd_2Fe_{14}B$ crystal particle.

EXAMPLE 20

R.Q.A. powders Nos. 52–55 in Table 33 containing Al were prepared in the above-described R.Q.A. powder producing method.

TABLE 33

| | R.Q.A. No. 52 | 53 | 54 | 55 |
|---|---|---|---|---|
| Nd (wt. %) | 50.0 | 50.0 | 50.0 | 50.0 |
| B (wt. %) | 1.0 | 1.0 | 1.0 | 1.0 |
| Al (wt. %) | 2.0 | 5.0 | 8.0 | 15.0 |
| Fe (wt. %) | bal. | bal. | bal. | bal. |

Each R.Q.A. powder of Nos. 52–55 was mixed with one or more selected from M.A. powders Nos. 1–3, 5, and 6 in Table 1 with a mixing ratio of 10 to 90 by volume to produce mixtures comprising Nd 30 wt. %, B 1.0 wt. %, Al and Fe as shown in Table 34. Sample magnets Nos. 137–140 were prepared in the similar processing steps as in Example 9. The magnetic properties of the resultant sample magnets Nos. 137–140 are also shown in Table 34.

For comparison, comparative magnets were prepared from ingots comprising elements similar to the sample magnets 137–140 and their magnetic properties are shown in Table 34.

TABLE 34

| Sample No. | R.Q.A. No. | MIXTURE (wt %) Al | Fe | Br (kG) | (BH)max (MGOe) | $_iH_C$ (kOe) |
|---|---|---|---|---|---|---|
| 137 | 52 | 0.2 | bal. | 15.0 | 54.5 | 10.8 |
| 138 | 53 | 0.48 | bal. | 14.9 | 53.0 | 12.5 |
| 139 | 54 | 0.74 | bal. | 14.7 | 51.5 | 14.3 |
| 140 | 55 | 1.32 | bal. | 14.3 | 49.0 | 15.5 |
| Comparative Samples (wt %) | | | | | | |
| Nd = 30, B = 1.0, Al = 0.2, Fe = bal. | | | | 13.8 | 43.0 | 7.4 |
| Nd = 30, B = 1.0, Al = 0.48, Fe = bal. | | | | 13.5 | 40.0 | 8.1 |
| Nd = 30, B = 1.0, Al = 0.74, Fe = bal. | | | | 13.5 | 39.0 | 8.6 |
| Nd = 30, B = 1.0, Al = 1.32, Fe = bal. | | | | 13.2 | 35.0 | 10.1 |

Used M.A. powder = Nos. 1–3, 5, and 6 in Table 1.
Amount of R.Q.A. powder = 10 vol %.

The sample magnets according to the present invention are superior to comparative magnets in magnetic properties.

EXAMPLE 21

R.Q.A. powders Nos. 56–62 containing Al and different Nd amounts were prepared as shown in Table 35.

TABLE 35

| | R.Q.A. No. 56 | 57 | 58 | 59 | 60 | 61 | 62 |
|---|---|---|---|---|---|---|---|
| Nd (wt. %) | 32.0 | 40.0 | 50.0 | 60.0 | 70.0 | 80.0 | 90.0 |
| B (wt. %) | 1.0 | 1.0 | 1.0 | 1.0 | 1.0 | 1.0 | 1.0 |
| Al (wt. %) | 8.0 | 8.0 | 8.0 | 8.0 | 8.0 | 8.0 | 8.0 |
| Fe (wt. %) | bal. | bal. | bal. | bal. | bal. | bal. | bal. |

Each R.Q.A. powder of Nos. 56–62 was mixed with one or more selected from M.A. powders Nos. 1–3, 5, and 6 in Table 1 with a mixing ratio of 10 to 90 by volume to prepare different mixtures each containing constant amount (30 wt. %) of Nd, as shown in Table 36. Sample magnets Nos. 141–147 were produced from those mixtures in the similar producing processes as in Example 9.

TABLE 36

| Sample No. | 141 | 142 | 143 | 144 | 145 | 146 | 147 |
|---|---|---|---|---|---|---|---|
| R.Q.A. No. | 56 | 57 | 58 | 59 | 60 | 61 | 62 |

Used M.A. powder = Nos. 1–3, 5, and 6 in Table 1.
Amount of M.A. powder = 90 vol. %.
Amount of R.Q.A. powder = 10 vol. %.
Nd amount in mixture of M.A. and R.Q.A. powders = 30 wt %.

Figure 15:
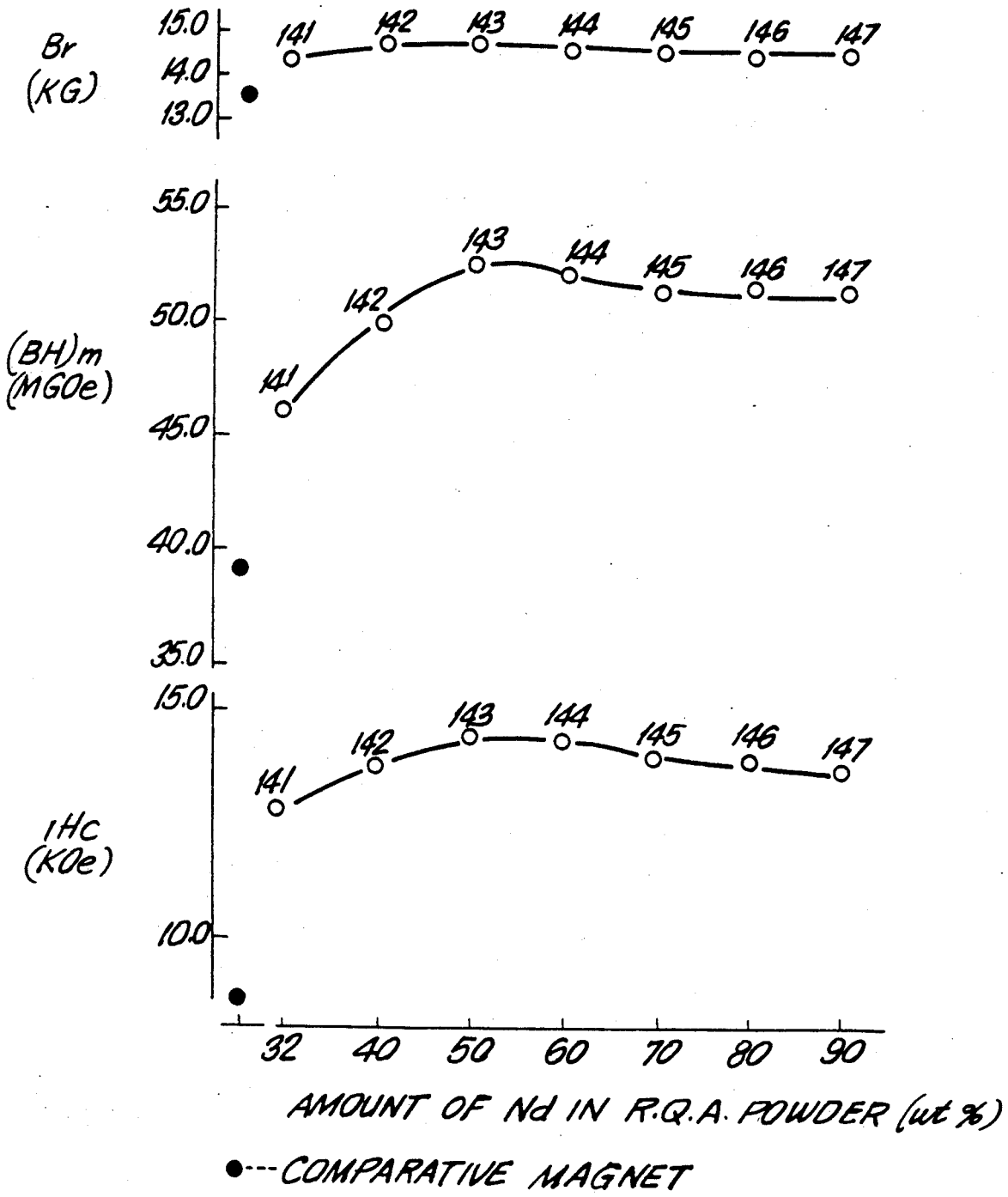
FIG. 15 is a graph showing magnetic properties of sample magnets in Example 21.

The magnetic properties of those sample magnets Nos. 141–147 are shown in FIG. 15 together with sample numbers.

A comparative magnet was prepared from an ingot comprising Nd 30 wt. %, B 1.0 wt. %, Al 0.75 wt. %, and Fe balance and its magnetic properties are shown at black points in FIG. 15.

Distribution of concentration of each elements in sample magnet No. 143 are also measured in the similar manner as in Example 18, and are shown in Table 37.

TABLE 37

| Measured Position | Anlysis elements (wt %) Nd | Al | Fe |
|---|---|---|---|
| Nd—Fe solid solution | 92.3 | 5.3 | 2.4 |
| 1 μm inside from $Nd_2Fe_{14}B$ particle surface | 28.3 | 0.5 | 71.2 |
| 3 μm inside from $Nd_2Fe_{14}B$ particle surface | 26.1 | 0 | 73.9 |
| 5 μm inside from $Nd_2Fe_{14}B$ particle surface | 27.4 | 0 | 72.6 |

It will also be understood from Table 37 that Al concentrate in the vicinity of the surface of $Nd_2Fe_{14}B$ crystal particle.

EXAMPLE 22

TABLE 38

| Sample No. | MIXTURE Nd 32 wt %, B 1.0 wt %, Al 8 wt %, Fe bal. M.A. (Vol. %) | R.Q.A. No. 56 (Vol. %) |
|---|---|---|
| 148 | 95 | 5 |
| 149 | 90 | 10 |
| 150 | 80 | 20 |
| 151 | 70 | 30 |
| 152 | 60 | 40 |
| 153 | 50 | 50 |
| 154 | 40 | 60 |
| 155 | 30 | 70 |
| 156 | 25 | 75 |

Used M.A. powder = Nos. 1–3, 5, and 6 in Table 1.

Figure 16:
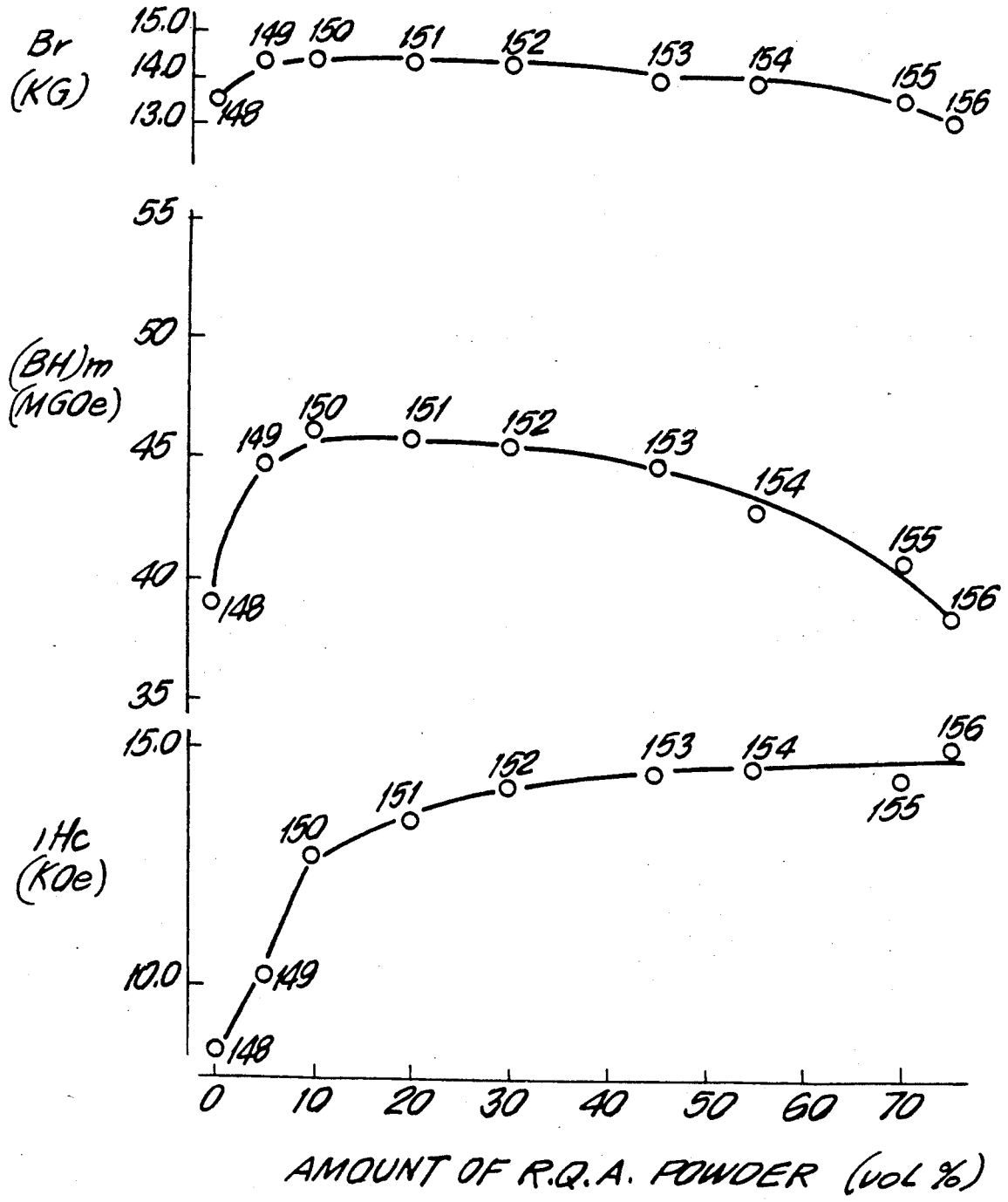
FIG. 16 is a graph showing magnetic properties of sample magnets in Example 22.

R.Q.A. powder No. 56 in Table 35 was mixed with one or more selected from M.A. powders Nos. 1–3, 5, and 6 in Table 1 with different mixing ratio by volume as shown in Table 38 to prepare nine mixtures each comprising Nd 32 wt. %, B 1.0 wt. %, Al 8.0 wt. %, and Fe balance. Sample magnets Nos. 148–156 were produced under conditions similar to Example 9. The magnetic properties of the sample magnets are shown in FIG. 16 together with sample numbers 148–156.

EXAMPLE 23

R.Q.A. powder No. 58 in Table 35 was mixed with respective M.A. powders Nos. 18, 15, and 19 to prepare different mixtures containing Nd 30 wt. %, B 1.0 wt. %, Al 0.73 wt. %, and (Fe+Co) balance, as shown in Table 39. Sample magnets Nos. 156–158 were prepared from respective mixtures in producing processes similar to the above described manner and their magnetic properties and Curie points Tc are shown in Table 39.

TABLE 39

| Sample No. | MIXTURE M.A. | MIXTURE R.Q.A. | Br (kG) | (BH)max (MGOe) | $_iH_C$ (kOe) | Tc °C. |
|---|---|---|---|---|---|---|
| 156 | No. 18 | No. 58 | 15.2 | 54.0 | 10.4 | 473 |
| 157 | 15 | 58 | 15.2 | 54.0 | 10.0 | 506 |
| 158 | 19 | 58 | 15.1 | 54.3 | 9.8 | 542 |
| Comparative | | | 13.9 | 35.0 | 5.3 | 508 |

Mixture; Nd 30 wt %, B 1.0 wt %, Al 0.73 wt %, Fe + Co bal.
Comparative; Nd 30 wt %, B 1.0 wt %, Al 10.4 wt %, Co 14.8 wt %, Fe bal.

Table 39 also shows magnetic properties and Curie point of a comparative magnet produced from an ingot comprising Nd 30 wt. %, B 1.0 wt. %, Al 0.73 wt. %, Co 14.8 wt. %, and Fe balance.

From Table 39, it will be noted that the magnets according to the present invention are superior to the comparative sample in magnetic properties and Curie point.

In the above described Examples, some elements were used for rare earth metals (R) including Y and for transition metals. However, the other rare earth metals and transition metals can be used to produce the similar advantages.

What is claimed is:

1. An iron-rare earth metal-boron permanent magnetic body with a high coercive force produced by liquid phase sintering, said magnetic body being characterized by a solid solution phase ranging up to about 70% by volume of said body, said solid solution phase being formed of at least one metal element (R) selected from the group consisting of yttrium and rare earth metals and at least one of boron (B) and a transition metal (T), with magnetic crystalline particles making up substantially the balance uniformly dispersed in said solid solution phase, each of said magnetic crystalline particles being a magnetic intermetallic compound represented by the chemical formula $R_2T_{14}B$, where R is at least one element selected from the group consisting of yttrium (Y) and rare earth metals, T being a transition metal but comprising Fe 50–100 wt. % of the transition metal present, said magnetic body being further characterized in that the oxygen content does not exceed 2,000 ppm and that the body exhibits a maximum energy product of at least about 40 MGOe.

2. A permanent magnet body as claimed in claim 1, wherein said solid solution phase is comprised of at least one metal element (R), said boron (B), and said transition metal (T), and wherein the amount of said at least one metal element is more than a stoichiometric amount present in the intermetallic compound $R_2T14B$.

3. A permanent magnet body as claimed in claim 2, wherein said solid solution phase contains iron (Fe) alone as said transition metal (T).

4. A permanent magnet body as claimed in claim 3, wherein said solid solution phase contains Fe and at least one substitution element selected from a group of Co, Ni, Cr, V, Ti, Mn, Cu, Zn, Zr, Nb, Mo, Hf, Ta, Al, Sn, Pb and W.

5. A permanent magnet body as claimed in claim 4, wherein the at least one substitution element is selected from the group Ni, Cr, V, Ti, and Mn in an amount ranging up to 0.7 molal ratio.

6. A permanent magnet body as claimed in claim 4, wherein the at least one substitution element is selected from the group Cu and Zn in an amount ranging up to 0.6 molal ratio.

7. A permanent magnet body as claimed in claim 4, wherein the at least one substitution element is selected from the group Zr, Nb, Mo, Hf, Ta, and W in an amount ranging up to 0.4 molal ratio.

8. A permanent magnet body as claimed in claim 4, wherein said solid solution phase contains Pb in addition to Fe as said transition metal, said Pb being concentrated in the vicinity of an outer surface of each of said magnetic crystalline particles.

9. A permanent magnet body as claimed in claim 4, wherein said solid solution phase contains Al in addition to Fe as said transition metal, said Al being concentrated in the vicinity of an outer surface of each of said magnetic crystalline particles.

10. A permanent magnet body as claimed in claim 4, wherein said metallic solid solution phase contains Cu in addition to Fe as said transition metal, said Cu being concentrated in the vicinity of an outer surface of each of said magnetic crystalline particles.

11. A permanent magnet body as claimed in claim 4, wherein said solid solution phase contains Cu and Ni in addition to Fe as said transition metal, said Cu and Ni being concentrated in the vicinity of an outer surface of each of said magnetic crystalline particles.

12. A permanent magnet body as claimed in claim 4, wherein said solid solution phase contains Cu, Co, and Sn in addition to Fe as said transition metal, said Cu, Co, and Sn being concentrated in the vicinity of an outer surface of each of said magnetic crystalline particles.

* * * * *